United States Patent [19]

Kano et al.

[11] Patent Number: 5,004,217

[45] Date of Patent: Apr. 2, 1991

[54] PAPER FEEDING DEVICE

[75] Inventors: Atsushi Kano, Amagasaki; Masayuki Mizuno, Osaka; Manabu Kajiwara, Takasago; Kenji Sakaue, Gojo; Yuji Abe, Hirakata; Kazuo Nakamura, Sakai, all of Japan

[73] Assignee: Mita Industrial Co., Ltd., Osaka, Japan

[21] Appl. No.: 518,323

[22] Filed: May 7, 1990

Related U.S. Application Data

[60] Continuation of Ser. No. 264,069, Oct. 28, 1988, which is a division of Ser. No. 177,903, Apr. 1, 1988, Pat. No. 4,813,612, which is a continuation of Ser. No. 866,505, May 23, 1986, abandoned.

[30] Foreign Application Priority Data

| | | | |
|---|---|---|---|
| May 24, 1985 | [JP] | Japan | 60-112399 |
| May 30, 1985 | [JP] | Japan | 60-117175 |
| Sep. 9, 1985 | [JP] | Japan | 60-197621 |
| Sep. 10, 1985 | [JP] | Japan | 60-139322 |
| Feb. 28, 1986 | [JP] | Japan | 61-29950 |

[51] Int. Cl.[5] ..... B65H 3/06

[52] U.S. Cl. ..... 271/10; 271/118; 271/127; 271/121; 271/164

[58] Field of Search ..... 271/117, 118, 10, 162, 271/164, 127, 121

[56] References Cited

U.S. PATENT DOCUMENTS

| | | | |
|---|---|---|---|
| 3,815,900 | 6/1974 | Schulze | 271/118 |
| 4,566,684 | 1/1986 | Gysling | 271/117 |
| 4,702,466 | 10/1987 | DuBois | 271/117 X |

FOREIGN PATENT DOCUMENTS

| | | |
|---|---|---|
| 3030384 | 3/1982 | Fed. Rep. of Germany . |
| 520614 | 5/1972 | Switzerland . |
| 1016700 | 1/1966 | United Kingdom . |
| 1496208 | 12/1977 | United Kingdom . |

*Primary Examiner*—Richard A. Schacher

*Attorney, Agent, or Firm*—Antonelli, Terry, Stout & Kraus

[57] ABSTRACT

A paper feeding device for a paper cassette of an image processing apparatus. The paper cassette is mounted at a specific position or the image processing apparatus in a manner permitting the cassette to be pulled out. A preliminary feed roller feeds the paper on the paper cassette toward a feed roller which is normally energized in a paper pressing direction. When the paper cassette is mounted in the image processing apparatus, the document setting board disposed in the paper cassette is upwardly turned by a pressing mechanism. When the paper cassette is pulled out, the feed roller from the paper cassette is turned in reverse direction. A feed channel to guide the paper from the paper cassette is formed in a curved manner, and a normally turned delivery roller is provided inside the curved channel.

2 Claims, 13 Drawing Sheets

PAPER FEEDING DEVICE

This application is a continuation of application Ser. No. 07/264,069, filed Oct. 28, 1988, which was a division of application Ser. No. 07/177,903 filed Apr. 1, 1988, now U.S. Pat. No. 4,813,612, which was a continuation of application Ser. No. 06/866,505 filed May 23, 1986 and now abandoned.

BACKGROUND OF THE INVENTION

The present invention relates to a paper feeding device to feed each sheet of image forming paper or document to an image processing apparatus such as copying machines and facsimile units.

Image processing apparatus such as copying machines and facsimile units are hitherto provided with a paper feeding device having a paper cassette and/or a stack bypass enabling to set a number of sheets of image forming paper, and/or a paper feeding device having an automatic document feeder enabling to set a number of sheets of documents.

The paper feeding device having the aforementioned paper feed cassette is advantageous in that the cassette can be changed easily when it is necessary to use a paper of different size. For copying machines, as an example, the document size to be copied recently tends to become larger, and a larger size of paper cassette has been used to accept a larger image forming paper corresponding to larger documents which are to be copied. When a paper feed cassette is mounted onto a copying machine proper, therefore, larger area for installing the copying machine is required than for the copying machine itself, which is causing a problem of lowered efficiency in use of the limited office space.

To solve the problem, a reverse paper feeding device has been proposed in which a direction of paper feeding from the paper cassette by the feed roller is set in opposite to a direction of paper feeding by a resist roller which operates synchronously with the optical system. In this case, the whole copying machine can be made compact even with the paper cassette being mounted by thereon so that the paper cassette may not be projected from the area of a vertical projection, for example, of the optical system which requires the largest plane size.

Such a reversing paper feeding device is composed of a feed roller to send out each sheet of paper from the paper cassette, a delivery roller to carry the paper fed from the feed roller toward a resist roller, and a guide member to reverse a direction of the paper carried by the delivery roller. The driving of feed roller and the resist roller are controlled in timing with a specific paper feeding, and driving of the delivery roller is also controlled in timing with the specific paper feeding by using a clutch or the like.

Accordingly, the feed roller and the delivery roller are driven to rotate enabling the preliminary paper feeding to the point where the front end of paper comes in contact with the resist roller, thereafter the delivery roller and the resist roller are driven to rotate enabling a paper feeding for accomplishing a copying operation.

With a reversing paper feeding device of the above composition, installation area of the copying machine can be made smaller and exact paper feeding can be ensured. It is necessary, however, to control driving of the delivery roller corresponding to driving condition of the feed roller and the resist roller which makes the electrical control system and mechanical revolution transfer mechanism more intricated as a disadvantage. And further the device is also disadvantageous in that the position of the delivery roller attached is rather limited making it difficult to design the whole paper feeding device, and additional members are necessary to attach the delivery roller.

Besides, in the conventional composition of the paper feeding device to feed each sheet of paper from a paper cassette which has no click to prevent double feeding by means of a feed roller and a friction pad pressed in contact with each other, a pressing mechanism to upwardly turn a document setting board mounted in the paper feed cassette so as to be turned freely is provided in the copying machine, and a pressure releasing lever mechanism to stop upward-turning of the document setting board by a means of pressure mechanism is also attached.

Under the condition where the document setting board is upwardly turned by the pressing mechanism when the paper feed cassette is mounted, therefore, the upper-most paper is pressed to the feed roller to enable paper feeding sheet by sheet. When the upward-turning of the document setting board is stopped by the pressure releasing lever mechanism, on the other hand, the pressing mechanism retreats from the paper cassette and the cassette can be pulled out.

By the paper feeding device of aforementioned mechanism, the document setting board can be upwardly turned simply by mounting a paper feed cassette, but the paper feeding device is disadvantageous in that the operation of pulling out the paper cassette is troublesome because the pressure release lever mechanism must be operated before pulling out the cassette. The need of a pressure release lever mechanism in addition to the pressure mechanism makes the composition of the whole paper feeding device more intricated and the manufacturing cost higher.

When the paper feeding device of the above composition is adopted, the front end of the next paper is positioned between the feed roller and the friction pad by the friction force between adjacent sheets of papers when feeding of one sheet of paper completes. If copying operation is continued as it is, there will be no problem, however, if it is necessary to change the paper size or the like, a new paper cassette must be mounted after pulling out the currently used paper cassette. While the cassette is changed, the paper of which top end is held between the feed roller and the friction pad remains in the copying machine, and a new paper feed cassette is set under this condition. Accordingly, the remaining paper is greatly crumpled or folded, and a jamming is finally resulted if the copying operation is kept going on.

To solve the above problem, a paper feeding device (Refer to the Japanese Patent Laid-Open Publication No. 203629/1982) has been proposed, in which the contact condition of the feed roller with the friction pad is released when the paper cassette is pulled out to prevent the paper from remaining in the copying machine.

By the paper feeding device of the above composition, only the contact condition of the feed roller with the friction pad is released when the paper cassette is pulled out and residual paper is prevented from remaining in the position between the feed roller and the friction pad by being pulled by the friction force between the residual paper and the papers stored in the paper cassette. In such a condition, remaining paper can be prevented from the remaining state rather accurately if the paper size is large, however, if the size is small, the paper carried to the specified position by the feed roller remains in the copying machine even when the paper cassette is pulled out, and jamming is resulted when a new paper feed cassette is set.

The problem is outstanding particularly for the type of copying machine in which almost part of the paper cassette is housed into the copying machine because the remaining paper can't be watched or checked easily from outside.

The aforementioned paper feeding device containing a stack bypass or an automatic document feeder has a preliminary feed roller and a feed roller and the preliminary feed roller is moved in opposite direction to paper pressing direction by a solenoid, a lever, a cam and the like under the condition where transmission of the driving force of the both rollers is cut off so that a number of sheets of paper can be set easily and exactly at the specified position.

At paper feeding operation, the preliminary feed roller is moved in paper pressing direction by the solenoid, the lever, the cam and the like and the both rollers are driven under this condition so that the paper is carried sheet by sheet.

By the composition to move the preliminary feed roller in paper pressing direction simply by applying force and without using any solenoid, lever, cam, or the like, the papers could be set rather easily at the specified position provided that the number of sheets of paper is comparatively small because the tangential direction of the preliminary feed roller at the point where the upper sheet of paper comes in contact is close to horizontal direction and the preliminary feed roller can be upwardly moved against the applied force. When the number of sheets of paper is increased, however, the tangential direction of the preliminary feed roller at the point where the upper top of paper comes in contact rises sharply and the vertical component of a force to upwardly move the preliminary feed roller against the applied force is quickly reduced, making it difficult to set the papers at the specified position.

If the number of sheets of paper is further increased and the upper surface of the papers goes up to the level approximately equal to the center axis of the preliminary feed roller, it becomes almost impossible to move the preliminary feed roller against the applied force and paper can hardly be set at the specified position. However, by employing the above-mentioned mechanism to move the preliminary feed roller with a solenoid, a lever, a cam, and the like paper setting can be made easily.

Though the paper setting can be exactly made, the paper feeding device of the aforementioned composition requires a mechanism to move the preliminary feed roller and also a means to control the mechanism, which is disadvantageous in that the whole paper feeding mechanism is intricated and the manufacturing cost is raised.

An object of the present invention is to ensure exact preliminary paper feeding and main paper feeding by reversing a paper-feed direction to the opposite without the need of driving a feed roller in a controlled manner.

Another object of the present invention is to enable the document setting board to be automatically rotated by a pressing mechanism, and to have the pressing mechanism automatically retreat from inside the paper cassette following the pulling out of an inserted paper cassette.

A further object of the invention is to prevent a paper from remaining when the paper feed cassette is pulled out.

A still further object of the invention is to make the whole paper feeding device simple by eliminating the complicated mechanism to move the preliminary feed roller and the means to control that mechanism so as to make the manufacturing cost lower.

It is also another object of the invention to prevent inclined paper feeding by raising the preliminary feed roller equally at the right and left sides in longitudinal direction thereof when paper is inserted.

In accordance with the present invention, in a paper feeding device in which a direction of delivering a document fed from the inside of a paper cassette by a feed roller is reversed so as to be conducted to a resist roller which operates synchronously with a movement of an optical system, there is provided a guide section which is composed of an outer guide plate and an inner guide plate to form a space for permitting the document to pass therethrough, and a delivery roller which is, in use, driven to rotate and is mounted on the guide section near the feed-roller side.

And preferably, the above paper cassette includes therein a document setting board to support a document, and the paper feeding device includes a pressing mechanism for lifting up the document setting board in a state that the paper cassette is set in the image processing apparatus, and a locking mechanism to prevent the pressing mechanism from lifting up the document setting board after removing the paper cassette.

More preferably, the paper feeding device includes a drive-force transmitting mechanism for transmitting to a feed roller a rotary force in the opposite direction to the paper-feeding direction the paper cassette from the image processing apparatus.

Further, in accordance with the present invention, a paper feeding device wherein a feed roller further feeds a document which is fed by a preliminary roller is characterized in that the preliminary feed roller is in use pushed in a direction to press the document, and there is provided a guide member which turns following an operation of setting the document on a predetermined position so as to move the preliminary feed roller in the opposite direction to the pressing direction on the document.

Preferably, the above guide member has on an end thereof a pushing section hanging at least over an end portion on the driving side of the shaft of the preliminary roller, and on the other end of the guide member a receiving section lying at least below the opposite end portion of the shaft of the preliminary roller.

DETAILED DESCRIPTION OF THE PREFERRED EMBODIMENTS

Figure 1:
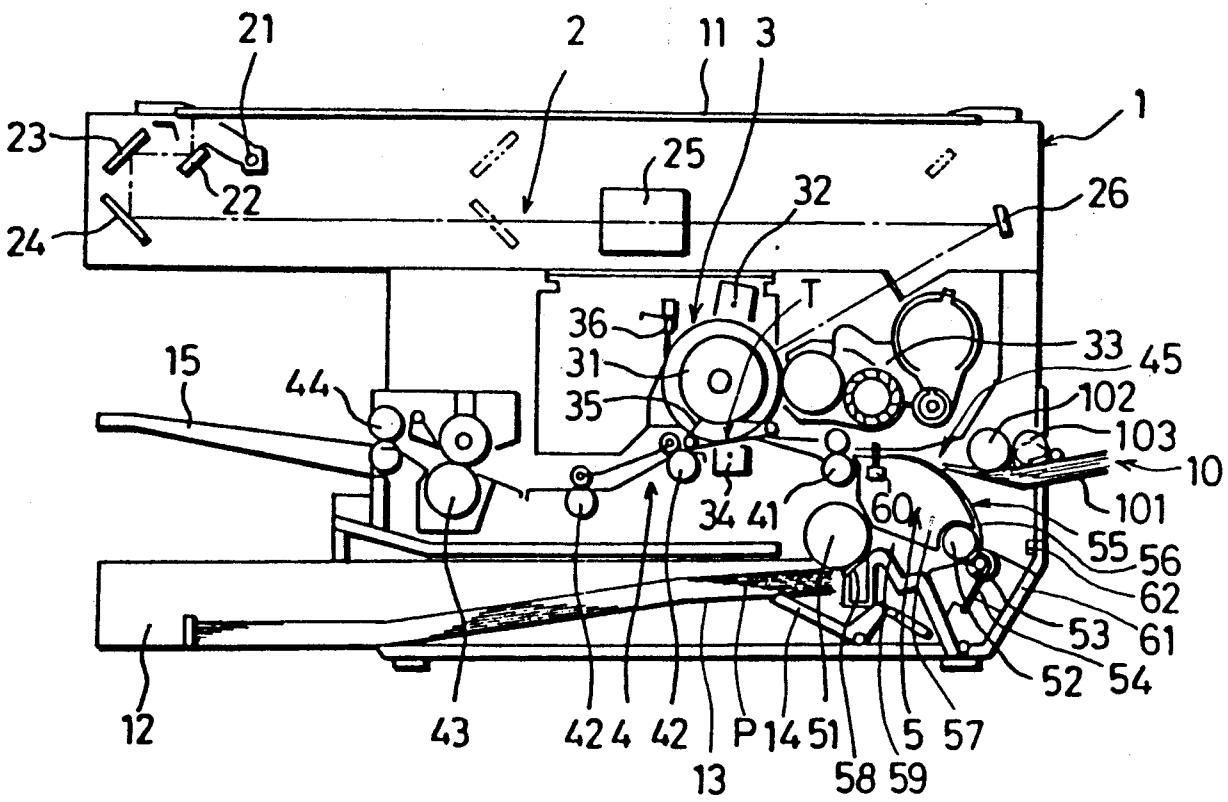
FIG. 1 shows the outline of the internal mechanism of a copying machine provided with a paper feeding device of the present invention.

FIG. 1 shows the outline of the internal mechanism of a copying machine incorporated with a paper feeding device of the present invention.

Of the whole housing (1) of the copying machine, the part incorporating the optical system (2) comprising a lamp, reflecting mirrors, and a lens is made wider and the other part incorporating the copying section (3) and the paper conveying section (4) is made narrower.

To be more specific, a contact glass (11) to set documents to be copied is provided at the specified position on the housing (1) of the copying machine.

The optical system (2) is composed of a lamp (21) to scan and expose documents while moving at a specified speed, reflecting mirrors (22) (23) (24) to lead the reflected light from the documents to a lens (25) while moving after the lamp (21), and a reflecting mirror (26) to lead the light coming through the lens (25) to the copying section (3).

The copying section (3) comprises a photoreceptor drum (31) which turns in one direction at every copying operation, corona dischargers (32), a developing device (33), a transferring corona discharger (34), a separating belt (35) and a cleaner (36) provided around the photoreceptor drum (31).

The paper conveying section (4) has the first paper feeding device (5) to feed out paper (P) sheet by sheet from the paper feed cassette (12) set on lower position of the copying section (3), a resist roller (41) driven synchronously with transferring of the lamp (21), a delivery roller (42) to carry the paper (P) separated from the photoreceptor drum (31) by the separating belt (35), a heating and fusing device (43), and a discharge roller (44) to discharge the paper (P) onto a discharge tray (15). A preliminary feed roller (103) to carry the paper (P) to the resist roller (41) and the 2nd paper feeding device (10) primarily made of a feed roller (102) are also attached to a specific position of a document tray (101) at a specific position of the copying machine housing (1) to enable selection of paper feed from the paper feed cassette (12) and from the document tray (101).

FIG. 2 to FIG. 5 show detailed composition of the 1st paper feeding device (5), which is primarily composed of a feed roller (51), delivery roller (52), driven roller (53) as a driven member, and a guide (55).

The feed roller (51) rotates while being pressed against the surface of the paper (P) held by a document setting board (13) which is turned upward by the lift-up lever (14) attached to a specific position in the copying machine housing (1) so as to feed out of paper (P) sheet by sheet and the paper is lead between the feed roller (51) and the friction pad (58) so that double paper feeding is prevented exactly.

Figure 6:
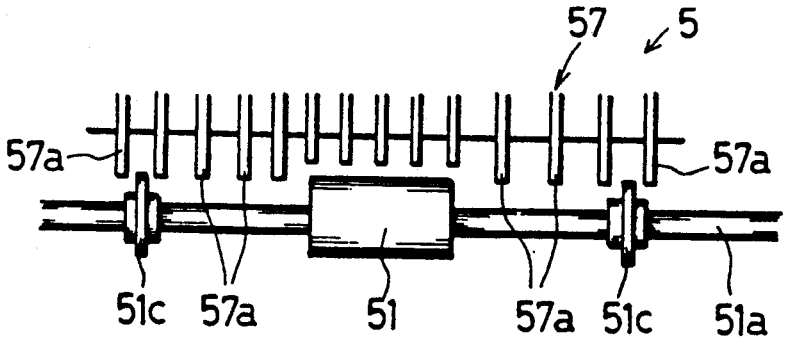
FIG. 6 is a plan view showing the attached condition of an auxiliary roller.

As shown in FIG. 6, an auxiliary roller (51*c*) to press the paper (P) on the end thereof is attached, in a manner to slide freely, to a sheet (51*a*) to which the feed roller (51) is also attached. When the feed roller (51) is mounted together with the shaft (51*a*), sliding range of the auxiliary roller (51*c*) is limited by a rib (57*a*) projected from outer surface of the inner guide member (57) as described later. Accordingly, manufacturing and assembling become easy. The auxiliary roller (51*c*) may be fixed to the shaft (51*a*) in advance, but attaching accuracy of the auxiliary roller (51*c*) must be higher in this case.

Figure 7:
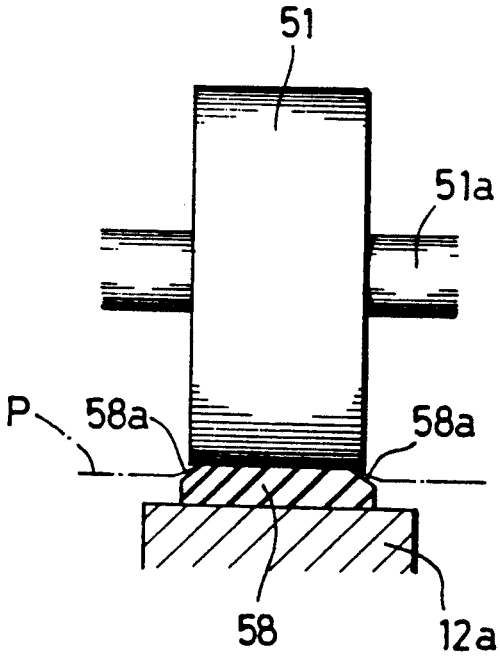
FIG. 7 is a longitudinal section showing the relationship between the feed roller and the friction pad.

As shown in FIG. 7, the friction pad (58) is fixed to a contact member (12*a*) which regulates setting position of the paper cassette (12) and is formed narrower than the feed roller (51).

An edge parallel to the paper feed direction is formed on the tapered face (58*a*) and the paper (P) caught between the feed roller (51) and the friction pad (58) is bent along the tapered face (58*a*) to prevent folding or cutting of the paper, and thus jamming is prevented if the paper (P) is carried as it is.

The paper (P) is allowed to be bent further along the feed roller (51) and the friction pad (58) to provide a space (59) where front end of the paper (P) can be corrected.

After the space (59), the delivery roller (52) normally turned and the driven roller (53) pressed against the delivery roller (52) by a plate spring (54) are attached, and the guide member (55) composed of an outer guide plate (56) and an inner guide member (57) is attached between the normally rotated delivery roller (52) or the driven roller (53) and aforementioned resist roller (41).

To be more specific, the paper cassette (12) has a document setting board (13) which can be turned in an up-and-down direction when the paper cassette is inserted into the copying machine housing (1). The up and down movement of the document is achieved by forcing one end of the document setting board to rotate about the other end of the document setting board which is pivotably secured to the paper cassette. Additionally a rectangular opening (63) is provided along the front end of the bottom plate of the paper feed cassette (12) and to the bottom portion of the front plate of the paper cassette which is first inserted into the housing.

A support (65) is fixed to the inner end of the bottom plate (64) of the copying machine housing (1) and a lift-up lever (14) is turnably attached between a set of brackets (66*a*) and (66*b*) provided on the support (65).

One bracket (66*a*) is fixed onto the support (65) with a set screw (67) and the other bracket (66*b*) is made in one piece with the support (65) by bending a part of the support (65), and the push lever (14) is held so as to turn upward and downward by projections (14*a*)(14*b*) provided at both sides of the bent part in the middle of the lift-up lever (14) and inserted into through holes (66*c*)(66*d*) made on the brackets (66*a*)(66*b*).

A stopper dent (14*c*) is also provided on the base of the lift-up lever (14) and another stopper dent (68*a*) is also provided on a bent part (68) at an inner side of the support (65), and a coil spring (69) to turn the lift-up lever (14) upward (clockwise direction in FIG. 4 and FIG. 5) is provided between the stopper dents (14*c*) and (68*a*).

A locking means (70) is provided in addition, which is composed of a locking mechanism (71) to lock the lift-up lever (14) in downward turning condition and of an lock-releasing mechanism (72) to release locking into upward turning condition.

Having an interlocking projection (14*d*) at a side of the base of the lift-up lever (14) and an interlocked projection (75*c*) to be locked with the interlocking projection (14*d*), the locking means (70) is turned to a locked condition (See FIG. 4) when the interlocking projection (14*d*) and the interlocked projection (75*c*) are interlocked with each other. The lock-releasing mechanism (72) has a release lever (75) of an arc shape and supports the release lever (75) between a pair of brackets (76*a*)(76*b*) provided on the support (65) in a manner that the lever can be turned freely.

That is, one bracket (76*a*) is made in one piece with the support (65) by bending a part of the support, and the other bracket (76*b*) is fixed onto the support by a set screw (77) and the release lever (75) is supported so as to turn freely by the projections (75*a*)(76*b*) at both sides of the base of the unlocking lever (75) inserted into the through holes (76*c*)(76*d*) provided on the brackets (76*a*)(76*b*). In addition, the bottom end of a plate spring (78) bent to approximately U-shape is fixed onto the support (65) with a screw (79) and the top end is put in contact with the outer face of the release lever (75) to turn the release lever (75) to the direction of the paper cassette (12) (counter-clockwise direction in FIG. 4 and FIG. 5).

Figure 4:
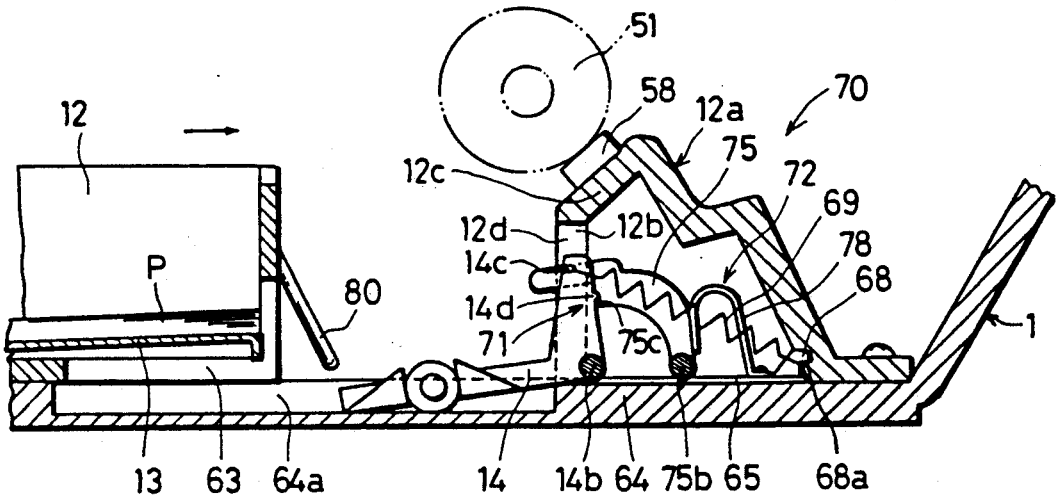
FIG. 4 is a longitudinal section of the principal part showing the condition with no paper feed cassette.
Figure 5:
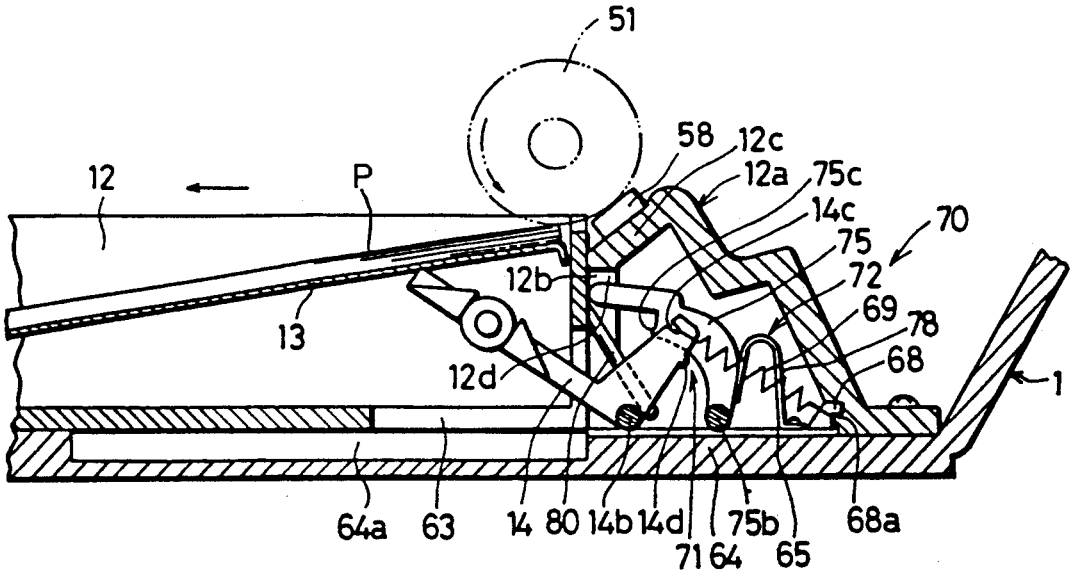
FIG. 5 is a longitudinal section of the principal part showing the condition with a paper feed cassette mounted.

The interlocked projection (75*c*) is provided on the release lever (75) corresponding to the interlocking projection (14*d*) provided on the lift-up lever (14). When the interlocking projection (14*d*) interlocks with the interlocked projection (75*c*), upward turning of the lift-up lever (14) by the coil spring (69) is prevented as shown in FIG. 4. i.e. locking condition is selected. When the locking projection (14*d*) is disengaged from the interlocked projection (75*c*), the lift-up lever (14) is turned upward by the coil spring (69), i.e. unlocking condition is selected.

The release lever (75) has a top end which comes in contact with the front plate of the paper cassette (12) mounted onto the copying machine, and operating pieces (80) extending downward diagonally are provided at the front side of the front plate of the paper feed cassette (12). There are two operating pieces (80) provided with certain spacing in a transversal direction of the paper feed cassete (12). Corresponding to the operating pieces (80), contained pieces (81) are provided at the top side of the lift-up lever (14).

The contacted pieces (81) are made of a contacted member (82) of triangular shape provided at a side of the lift-up lever (14), and a contacted roller (84) supported at the side with a short shaft (83) so as to turn freely, and the surface of the contacted member (82) is inclined upward to the side of the contracted roller (84). It is preferable to provide a guide member (85) of approximately the same shape as the contacted member (82) symetrically to the contacted member (82) around the contacted roller (84).

Figure 8:
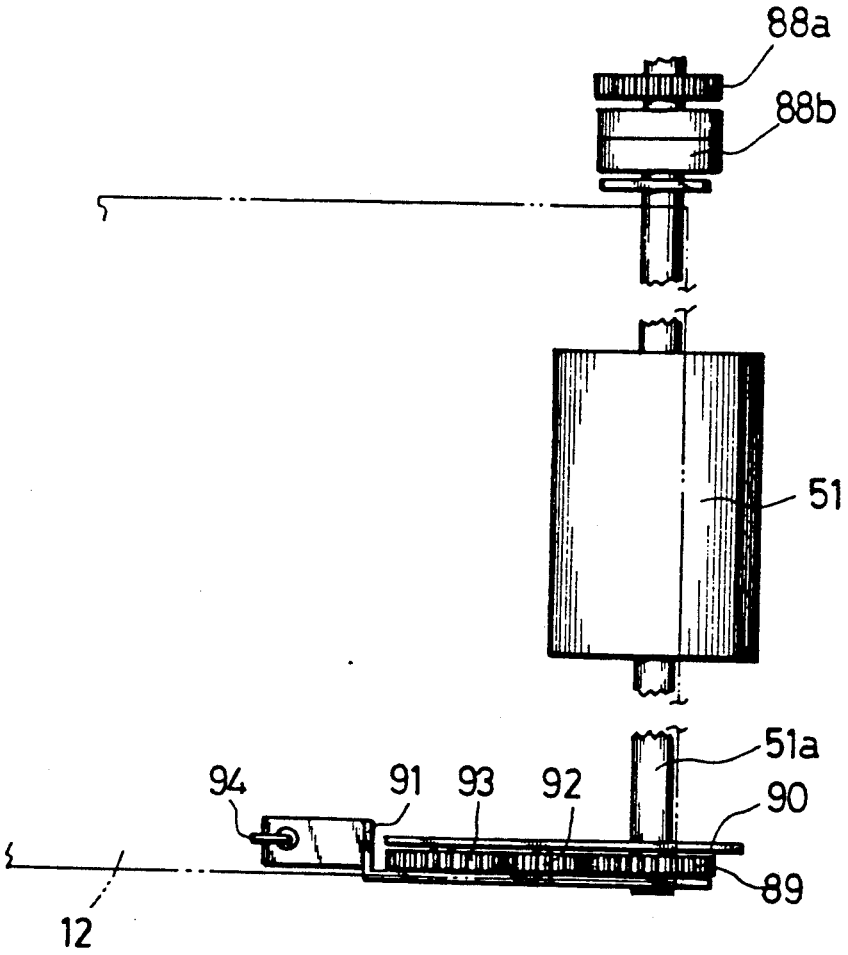
FIG. 8 is a plan view showing a mechanism to rotate in opposite direction to paper feeding.
Figure 9:
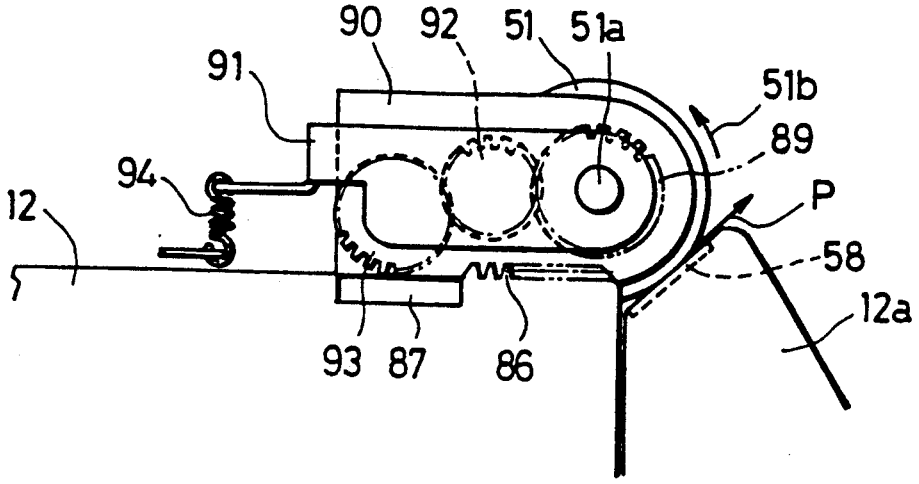
FIG. 9 is a side view showing paper feed condition.
Figure 10:
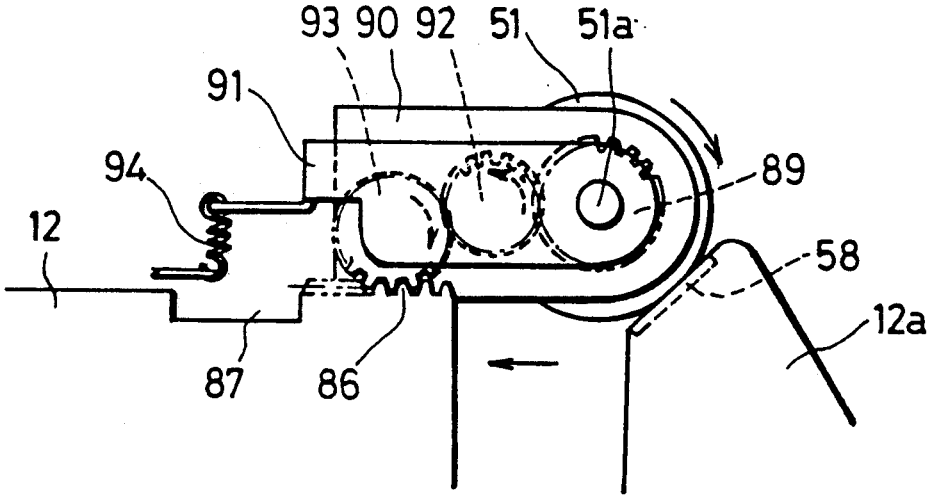
FIG. 10 is a side view showing the condition of pulling out a paper feed cassette.

The contact member (12*a*) has a contact part (12*b*) extending substantially vertically upward and an inclined part (12*c*) extending upward slantwise from the top end of the contact part (12*b*) in paper carrying direction, and covers the top of the support (65). The top side of the lift-up lever (14) and the top end of the release lever (75) are projected through an opening (12*d*) formed at approximately the center in transversal direction of the contact member (12*b*) (width-direction of the paper P). On the bottom plate (64) of the copying machine housing (1), a housing space (64*a*) is provided to accept the top end of the lift-up lever (14) when the lever (14) turns downward. As shown in FIG. 8 to FIG. 10, a rack (86) is made at the upper front of one side plate of the paper cassette, and a storage space (87) is provided immediately after the back side of the rack (86). Driving force of the driving power source (not illustrated) is transmitted at a specified timing to one end of the shaft (51*a*) to which the feed roller (51) is attached through a driving force transmission mechanism comprising a gear (88*a*) and a clutch (88*b*). To the other end of the shaft (51*a*), a gear (89), a gear attaching plate (90) and a lever (91) are attached. At a specified position of the gear attaching plate (90), a gear (92) to be interlocked with the gear (89) and another gear (93) to be interlocked with the gear (92) are attached. The lever (91) and the gear attaching plate (90) are turned downward around the shaft (51*a*) by a tension spring (94) provided between the top end of the lever (91) and a fixed point in the copying machine housing (1).

The storage space (87) is provided at a position where the gear (93) can be housed when the paper feed cassette (12) is mounted completely so that the gear (93) following revolution of the feed roller (51) for paper feeding can be turned freely. The feed roller (51) can also be turned in reverse direction to paper feeding by the gear (93) interlocked with the rack (86) following pull-out motion of the paper cassette (12).

As shown in FIG. 6, the inner guide member (57) is totally made of synthetic resin and a plurality of ribs with convex curvature on the side are provided on the outer surface of the guide member. An outer guide plate (56) made of steel or the like is attached with about 1 mm spacing to the top of the ribs and the space between the ribs and the outer guide plate is used for paper transfer.

The delivery roller (52) is supported, in a manner to turn freely, at a position a little off the above mentioned space of the inner guide member (57), and a switch (60) to detect the paper (P) is held immediately before the resist roller (41). The driven roller (53) is attached to an opening and closing member (61) which is held onto the copying machine housing (1) by a plate spring (54) so as to be opened and closed. When the opening and closing member (61) is opened, the driven roller (53) is kept off the delivery roller (52), and under closed condition of the opening and closing member (61), the driven roller (53) is pressed in contact with the delivery roller (52). The pressure of the plate spring (54), however, is set smaller than the firmness of the paper (P). The magnet (62) is to keep the opening and closing (61) at closed condition.

Operation of the 1st paper feeding device (5) is as shown below. When the paper feed cassette (12) is not set, the lift-up lever (14) turns downward, as shown in FIG. 4, and the interlocking projection (14*d*) interlocks with the interlocked projection (75*c*) of the release lever (75) to keep the downward turning operation. When the paper feed cassette (12) is inserted through the opening of the copying machine housing (1) under this condition, lower end of the pair of operating pieces (80) at the front side plate of the paper cassette (2) first comes in contact with the upper face of the corresponding guide member (85). As the cassette is inserted further, it goes over the guide member (85), the contacted roller (84) and the contacted member (82) in the order as mentioned. While going over, the front side of the paper feed cassette (12) is moved up and down to some extent due to the inclined face of the guide member (85) and the contacted member (82).

As the paper cassette (12) is kept inserted further, the front side plate comes in contact with the top end of the release lever (75) just before the end of setting of the paper feed cassette (12) i.e. immediately before the front plate of the paper cassette (12) comes in contact with the contact part (12*b*) of the contact member (12*a*), then the release lever (75) turns clockwise against the pressure of the plate spring (78) as the paper feed cassette (12) moves.

At the end of setting of the paper feed cassette (12), the interlocking projection (14*d*) of the push lever (14) is released from the interlocked projection (75*c*) of the release lever (75), then the lift-up lever (14) is turned upward by the coil spring (69) to turn the document setting board (13) upward (counter-clockwise direction in FIG. 5) and to put the feed roller (51) in pressed contact with the paper (P) at the top thereof. (See FIG. 5.)

Accordingly, rotary force is transmitted to the shaft (51*a*) through the driving force transmission mechanism comprising the gear (88*a*) and the clutch (88*b*) and the feed roller (51) is rotated in the direction indicated by an arrow (51*b*) to feed the paper (P) out of the paper feed cassette (12). If two or more sheets of papers (P) are sent out at a time, the friction resistance between the friction pad (58) and the paper (P) functions to feed out the upper-most paper (P).

During the paper feed operation, the gear (93) is also rotated but the rotation is idle as it is housed in the storage spaces (87) and causes no problem.

The sheet of paper (P) sent out between the feed roller (51) and the friction pad (58) is led through the space (59) to the position between the delivery roller (52) and the driven roller (53). Since revolution of the delivery roller (52) is applied as the carrying force of the paper (P), the carrying force is sufficient to carry the paper (P) through the guide (55) and contact with the resist roller (41). Even after the front end of the paper (P) touches the resist roller (41), the paper (P) is carried further for certain time by the delivery roller (52), and the paper (P) fits along the whole surface of the outer guide plate (56) as shown by the continuous line in FIG. 2. Because of the firmness of the paper (P), the driven roller (53) is moved against the pressure of the spring (54), which serves to keep the paper (P) under the condition of no carrying force applied although the delivery roller (52) is kept turning. This arrangement exactly prevents the trouble that the paper (P) is carried to the resist roller (41) more than necessary resulting in jamming. If the paper (P) is not very firm, the driven roller (53) is little moved but the contact pressure to the delivery roller (52) is lessened and the delivery roller slips on the paper (P) thus carrying of the paper (P) is stopped.

The preliminary paper feeding stops under the condition where the paper (P) is slackened from the regular carrying face by about 5 to 10 mm in the space (59) and front end of the paper (P) can be corrected.

For the following paper feeding, the feed roller (51) is kept suspended, and the friction between the friction pad (58) and the paper (P) functions as a resisting force. When carrying of the paper (P) by the resist roller (41) starts, the paper (P) is immediately pulled and fitted along the outer surface of the inner guide member (57), as shown by the broken line in FIG. 2. At this point the as firmness of the paper (P) is no longer enough to separate the driven roller (53) from the delivery roller (52). The driven roller (53) is strongly pressed, therefore, to the delivery roller (52) and revolution of the delivery roller (52) functions for carrying the paper (P) without any slipping. The carrying force applied to the paper (P) by the resist roller (41) and the delivery roller (52) overcomes the resistance to complete the paper feeding to the copying section (3).

Should jamming happen between the feed roller (51) and the delivery roller (52), the blocked paper (P) can be removed easily by opening the opening and closing member (61).

Figure 2:
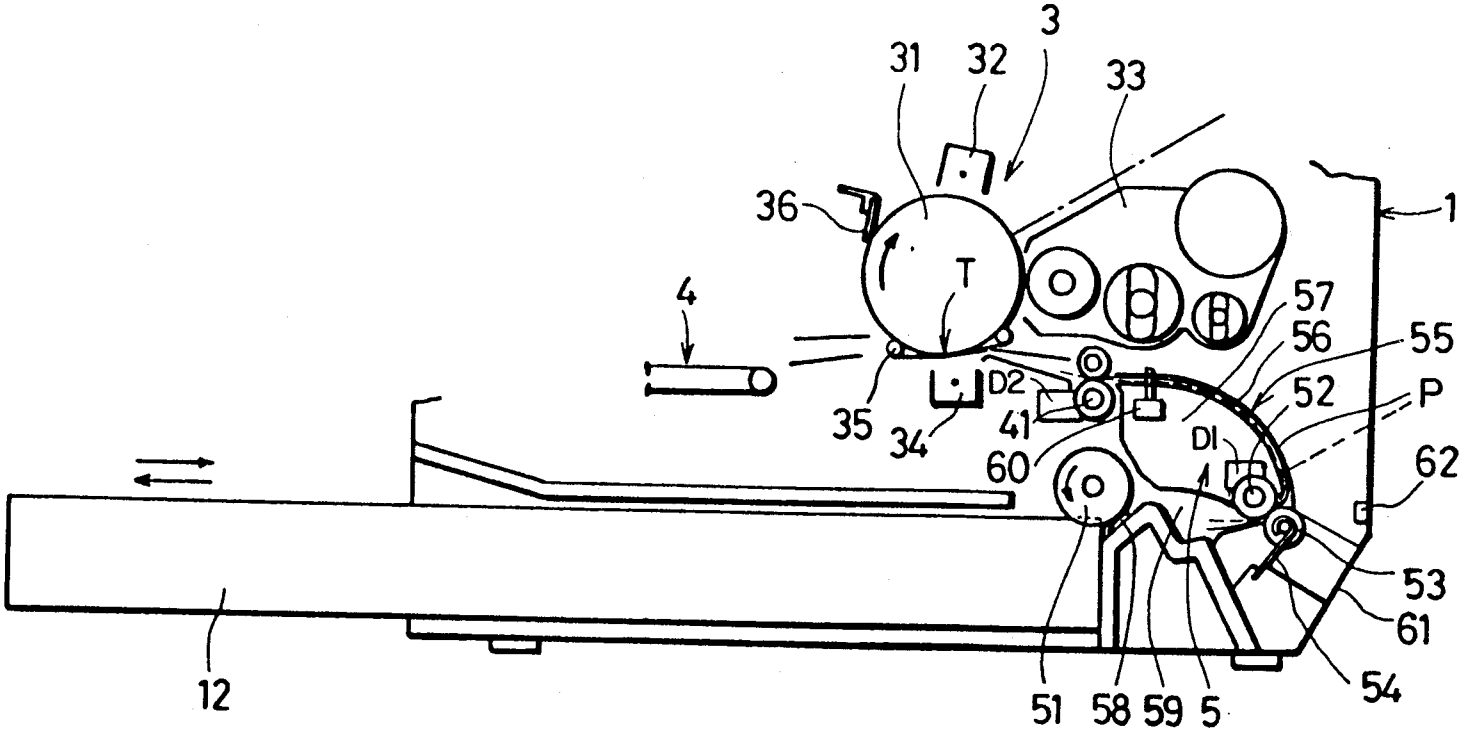
FIG. 2 is an enlarged longitudinal section of the paper feeding device of FIG. 1.
Figure 3:
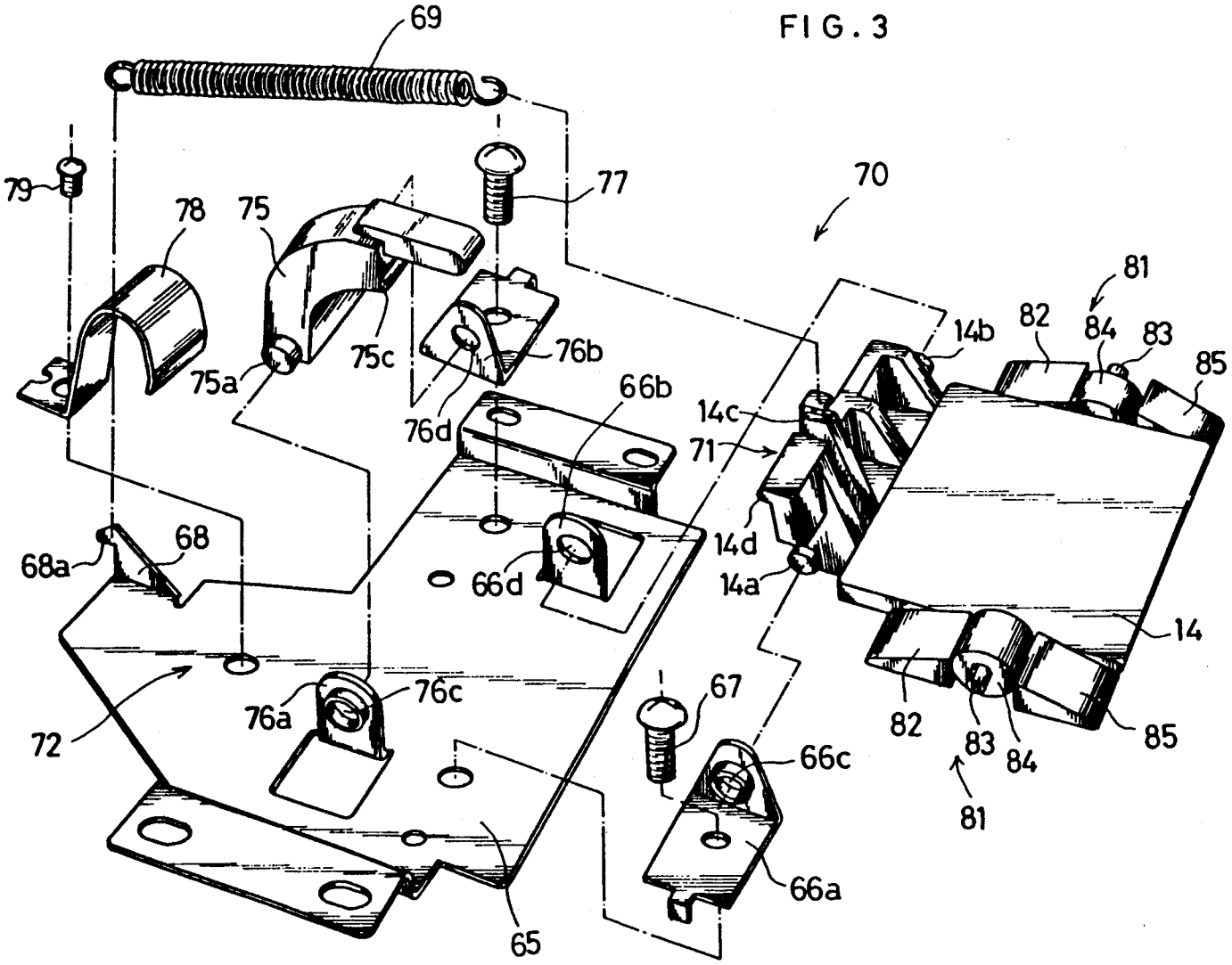
FIG. 3 is an exploded perspective side view of the paper feeding device in FIG. 1.

If the paper cassette (12) must be pulled out to replenish paper (P) or to change the size of the paper in use (P), the release lever (75) first turns downward following transfer of the paper feed cassette (12) to the outside (left side in FIG. 2). The paper feed cassette (12) moves outward further to go off the top of the release lever (75), then each one of the operating piece (80) comes in contact with the contacted part (81) to turn the lift-up lever (14) downward. At the end of downward turning of the lift-up lever (14), the interlocking projection (14*d*) interlocks with arc-shaped inner surface of the release lever (75) to turn the release lever (75) upward, then the interlocking projection (14*d*) goes over the interlocking projection (75*c*). Accordingly, downward turning the lift-up lever (14) can be maintained by the interlocking projection (14*d*) interlocked with the interlocked projection (75*c*) even if the paper cassette (12) move outward further and downward turning power of the lift-up lever (14) by the operating piece (80) is no longer effective.

In the initial stage of pulling out of the paper feed cassette (12), the gear (93) goes off the storage space (87) and is interlocked with the rack (86) (See FIG. 10.). Accordingly, the gear (93) rotates following outward movement of the paper feed cassette (12) and rotary force in reverse direction to paper feeding is transmitted to the shaft (51*a*) through the gears (92),(89). In this case, transmission of the driving force is normally shut off by the clutch (88*b*), and the feed roller (51) is rotated in reverse direction to paper feeding, and the paper (P) of which the top end is caught between the feed roller

(51) and the friction pad (58) is carried in reverse direction, i.e. to the paper feed cassette (12) so as to be free. If the paper feed cassette (12) is pulled out while the clutch (88*b*) is still kept in the condition of driving power transmission, the gear (93) turns upward around the shaft (51*a*) to be released from the rack (86), and collision of the gear (93) against the rack (86) is prevented.

As is made clear in the above description, upward or downward turning of the lift-up lever (14) is selected automatically following setting and pulling-out of the paper cassette (12) resulting in easy setting and pulling-out of the cassette (12). At pulling out of the paper feed cassette (12), the feed roller (51) turns in reverse direction to paper feeding in the initial stage of pulling, and top end of the paper (P) is not caught between the feed roller (51) and the friction pad (58) and the contact area of the paper with the friction pad (58) is kept less. This serves to pull out the paper (P) completely together with the paper feed cassette (12) and prevents the paper (P) from the remaining in the copying machine housing (1).

Although the delivery roller (52) is kept turned throughout paper feeding operation, carrying force is applied to the paper (P) only while the driven roller (53) is pressed onto the delivery roller (52). This means that a carrying force is applied to the paper by feed roller (51) while the paper being fed is between the feed roller and the friction pad (58). Also, a carrying force is applied to the paper by the delivery roller (52) from the time the paper being fed passes between the delivery roller and the driven roller (53) up until the time the leading edge of the paper being fed comes in contact with the suspended resist roller (41) causing the paper to bend to conform to the inner surface of the outer guide plate. While the paper is positioned so as to conform to the inner surface of the outer guide plate (56), the driven roller (53) is moved against the pressure of the spring (54), and, thus, no carrying force is applied to the paper. Subsequently, when resist roller (41) is rotated and the paper is pulled and fitted along the outer surface of the inner guide plate (57), the firmness of the paper is no longer sufficient to separate the delivery roller (52) from the driven roller (53), and, thus, the delivery roller again applies a carrying force to the paper being fed through the feeding device. Under any other condition than above, no or almost no carrying force is applied to the paper (P) and paper feeding is free from any trouble.

It is most preferable to position the feed roller (52) at a point where carrying direction of the paper (P) changes sharply, as illustrated, so that selection and control of the condition where carrying force can be transmitted exactly by firmness of the paper (P) and of the condition where carrying force is little transmitted due to slipping can be practiced exactly with no regard to friction resistance of the delivery roller (52). As known from the above description, the driven roller (53) is not necessarily required and can be omitted because carrying force transmission condition and slip condition can be selected only if the contact pressure to the delivery roller (52) can be changed according to transfer condition of the paper (P).

If the lift-up lever (14) can be turned by the operating piece (80), the contacted member (82) can also be omitted and it is possible to provide the operating piece (80) and the contacted part (81) at one side only.

Figure 11:
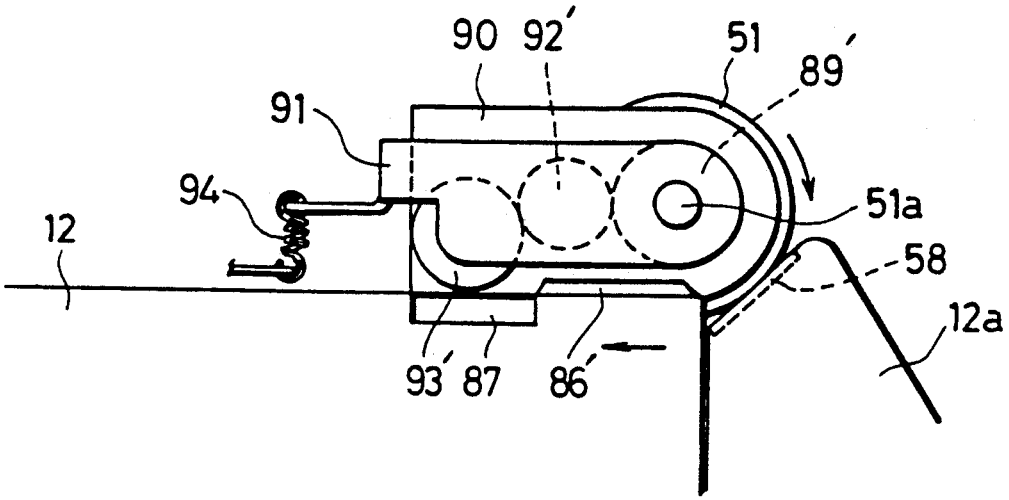
FIG. 11 is a side view showing another embodiment of the mechanism to rotate the feed roller in opposite direction to paper feeding.

When rollers (89') (92') (93') for driving power transmission are used in place of the gears (89) (92) (93) as the mechanism to turn the feed roller (51) in reverse direction to paper feeding, as shown in FIG. 11, and a friction pad (86') is used instead of the rack (86), it is possible to turn the roller (93') following transfer of the paper cassette 12) by the friction force between the friction pad (86') and the roller (93') and to turn the feed roller (51) in reverse direction to paper feeding.

Figure 12:
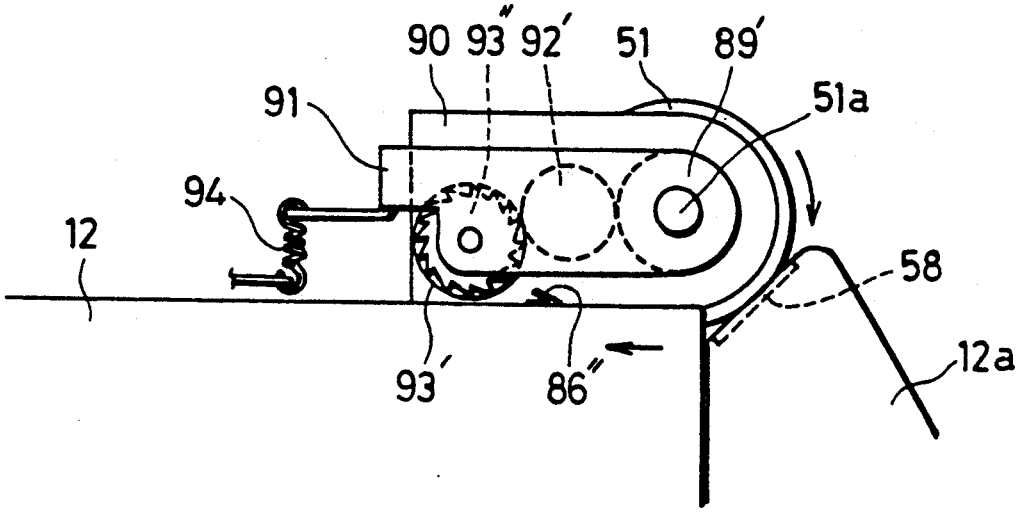
FIG. 12 is a side view showing still other embodiment.
Figure 13:
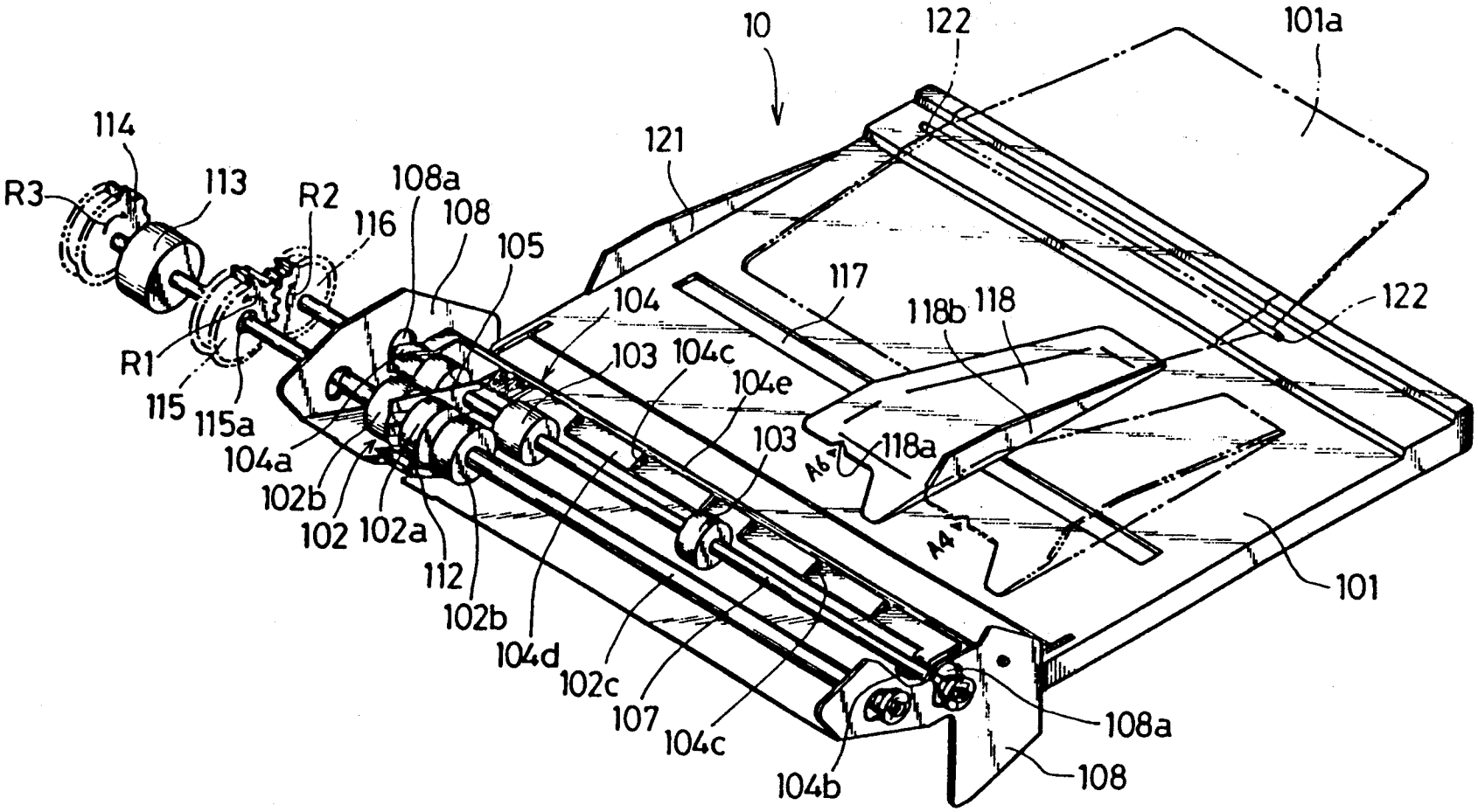
FIG. 13 is a perspective view of the paper feeding device of FIG. 2.

When a rachet gear (93'') is attached coaxially to the roller (93'), as shown in FIG. 12, and a rachet pawl (86'') is used in place of the friction pad (86'), the feed roller (51) can be rotated in reverse direction to paper feeding by turning the rachet gear (93'') only at the pulling-out operation of the paper feed cassette (12).

FIG. 13 to FIG. 17 shows details of the composition of the second paper feeding device (10), which is primarily made of a document tray (101), feed roller (102), preliminary feed roller (103) and a guide member (104).

The preliminary feed roller (103) comprises a plurality of friction rollers attached with certain spacing from each other at specified positions along a shaft (107) to which rotary force is transmited through an idler gear (115) and a driving gear (116). Both ends of the shaft (107) are interlocked with a long hole (108*a*) made at a specified position in a side plate (108) to press the preliminary feed roller in paper pressing direction by its own weight. Rotary force to the shaft (107) is transmitted only when the paper (P) is sensed by a limit switch (100).

The guide member (104) is held at a specified position for paper insertion inside of the side plate (108) so as to turn freely. The top edges of both ends of the guide member (104) project respectively toward the shaft (107) to form a pushing section (104*a*) extending over the driving end of the shaft (107) and also a receiving section (104*b*) extending beneath the opposite end of the driving side of the shaft (107) so that the preliminary feed roller (103) can be moved upward without being inclined. The guide member (104) is reinforced by a rib (104*c*) provided on the upper face of the guide member (104).

The feed roller (102) is attached to the down-stream side of the preliminary feed roller a center which prevents double feeding of the paper (P). Paper (P) is being pressed by a friction pad (112), attached at a specific position to the top end side of the document tray (101). Feed roller (102) also includes auxiliary rollers (102*b*) which are positioned on both sides of the center roller (102*a*) and are attached to a shaft (102*c*).

Like the above-mentioned friction pad (58) (See FIG. 7.), the friction pad (112) is narrower than the center roller (102*a*), and its edge has a tapered face (112*a*) parallel to feeding direction of the paper (P).

For ordinary paper (P), only the center roller (102*a*) is used for paper feeding. When paper having a high friction factor, such as thick paper, a second original, or OHP paper, is to be fed, the carrying force of the auxiliary rollers (102*b*) is applied to obtain a higher carrying force than the friction from the friction pad (112) so as to ensure exact paper feeding.

In more detail, the friction pad (112) is pressed upward by the spring (112*b*) to maintain contact with the center roller (102*a*). Corresponding to the auxiliary rollers (102*b*), recesses (102*d*) are provided on the document tray (101), into which the auxiliary rollers (102*b*) are positioned to the extent that do not come in contact with the surface of recesses (102*d*). The paper (P) is fed between the center rollers (102*a*) and the auxiliary roller (102*b*), and the document tray (101), being caught by the rollers (102*a*) (102*b*) and the document tray (101), as shown by the alternate one-dot chain line in FIG. 17 so as to transmit the carrying force exactly.

Since the auxiliary rollers (102*b*) are not in contact with the recesses (102*d*), the carrying force is somewhat lower than in the case where the roller is in direct contact with the recesses, and double feeding of the paper is prevented. The mechanism to transit the rotary force from the driving power source (not shown) to the shaft (102*c*) is composed of a clutch (113), connected to one end of the shaft (102*c*), and a drive gear (114), to transmit the rotary force from the driving power source (not shown) to the clutch (113). The shaft (102*c*) is driven only when the rotary force is tramsmitted to the clutch (113).

A bend control plate (105), having recesses (105*a*) (105*b*) at both ends, is supported in such a manner that the recesses (105*a*) (105*b*) are interlocked respectively with the shafts (107) (102*c*), and in this supported condition the lower surface (105*c*) of the bend control plate (105) comes close to the upper-most paper (P) set on the document tray (101). Accordingly, the spacing between the upper-most paper (P) and the lower face (105*c*) of the bend control plate (105) is kept approximately constant without regard to the quantity of the paper (P). This prevents the paper (P) from being bent upward too much between the feed roller (102) and the preliminary feed roller (103) when carrying force is applied by the preliminary feed roller (103) only. Only one sheet of the bend control plate (105) may be held at a position close to the center roller (102*a*). It is also possible to support a plurality of sheets of the bend control plate (105) with certain spacing or to bend the bend control plate (105) in the middle so that the interlocking positions with the shafts (102*c*)(107) are offset from each other.

The mechanism to tranmit the rotary force from the driving power source (not illustrated) to the shaft (107) is composed of an idler gear (115) attached to the shaft (102*c*) through a bearing (115*a*) so as to turn freely, and a driving gear (116) fixed to one end of the shaft (107) and interlocked with the idler gear (115). Idler gear (115) turns in the same direction as does the shaft (102*c*).

The document tray (101) has a notch (117) approximately at the center and in the direction perpendicular to the paper feeding direction, and a projection (119) on a side control plate (118) is interlocked with the notch (117) and is fastened with a stop ring (120). Accordingly, the side control plate (118) can slide freely along the notch (117). By fitting a cut mark (118*a*) suitably to the appropriate paper size indication, one end of the paper (P) can be controlled by a vertical part (118*b*) rising vertically from the side control plate (118). Paper of a desired size can be fed by fitting the side control plate (118) to the corresponding size indication. To feed paper of the A6 size, for example, fit the cut mark (118*a*) to the A6 position. For feeding A4 size paper, move the side control plate (118) to the position shown by the two-dot chain line to fit the cut mark (118*a*) to the A4 position. The other side of the paper is controlled by a control part (121) rising vertically from the document tray (101). Since the reference for the second paper feeding device (10) is at the side of the control part (121), i.e. one side reference, the paper (P) is first put in contact with the control part (121), then the side control plate (118) is slid to control the other side of the paper (P). A foldable projection (101*a*) is provided on the document tray (101), and the projection (101*a*) can be rotated freely around the shaft (122). For large size paper, therefore, the projection (101*a*) is opened to support the paper (P) on the rear end. For small size paper, the projection (101*a*) is folded and the side control plate (118) slides on the projection (101*a*). The document tray (101) is attached to the side plates (108)(108) so as to turn freely around the fulcrum point (123).

Figure 14:
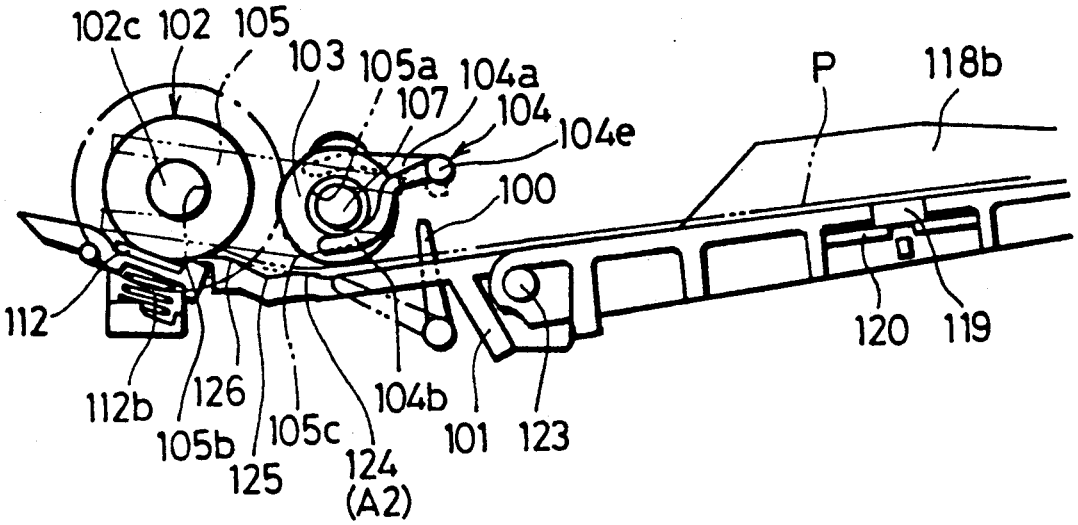
FIG. 14 is a schematic longitudinal section showing the condition of setting a small number of sheets of paper.

The top end of the document tray (101) is inclined downward toward the down-stream side of paper feed so that the paper (P) can be inserted easily. After passing nearly to the bottom of the preliminary feed roller (103), however, the document tray (101) turns upward, and the inclination is increased gradually toward a downstream side, with the first crest (124), a root (125), a second crest (126) for better transfer of this inclination extends to the point where the feed roller (102) comes into contact with the friction pad (112). As FIG. 16 indicates, the inclination from point A1, right under the preliminary feed roller (103), to the first crest (124) is an easy slope, and the height is not very high. The inclination from the root (125) to the second crest (126) has a sharp slope and is so arranged that the top of the second crest (126) is at a point lying on a line defined by the extension from point A1 beneath the preliminary feed roller (103) to point A2 on the first crest (124). If the number of sheets of paper (P) from the second paper feeding device (10) is small, the paper (P) is fed as the preliminary feed roller (103) rotates, as shown in FIG. 14. Even after passing through point A2, the paper does not fall down into the root (125) because of the firmness of the paper. The paper goes to the top of the second crest (126), as shown by the one-dot chain line, and then is supported by the first and the second crests (124) (126) to come in contact with a specified position of the feed roller (102), and the transfer stops. If the first crest (124) is not provided, it may possible that the paper (P) falls into the root (125) and does not come in contact with the feed roller (102).

Figure 15:
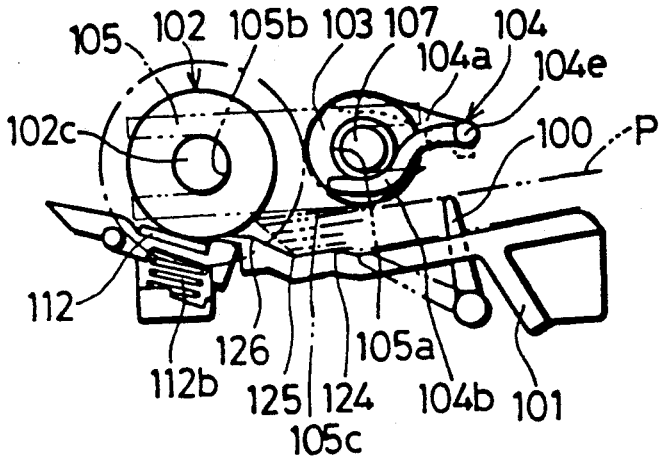
FIG. 15 is a schematic longitudinal section showing the condition of setting a large number of sheets of paper.

When a large number of sheets of paper (P) is in second paper feeding device (10) to be fed, the paper (P) follows moves with the preliminary feed roller (103), as shown in FIG. 15, and falls into the root (125) because of its own weight, where the lower-most paper stops. Upper layers of the paper are inclined toward the feed roller (102). When the upper-most layer comes in contact with the feed roller (102) at a position not so far upward from the position where the feed roller (102) touches the friction pad (112), the paper carrying stops. Smooth paper feeding is ensured because the paper assumes a stand-by condition when coming in contact with approximately the same point of the feed roller (102) without regard to the number of stacked sheets of the paper (P).

Figure 16:
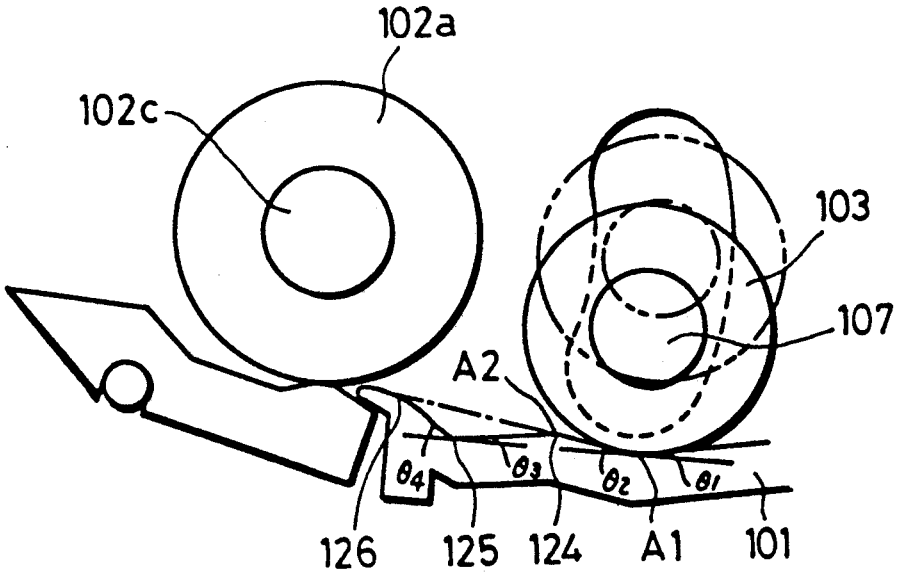
FIG. 16 is an enlarged and schematic longitudinal section showing a document tray, feed roller, and preliminary feed roller.
Figure 17:
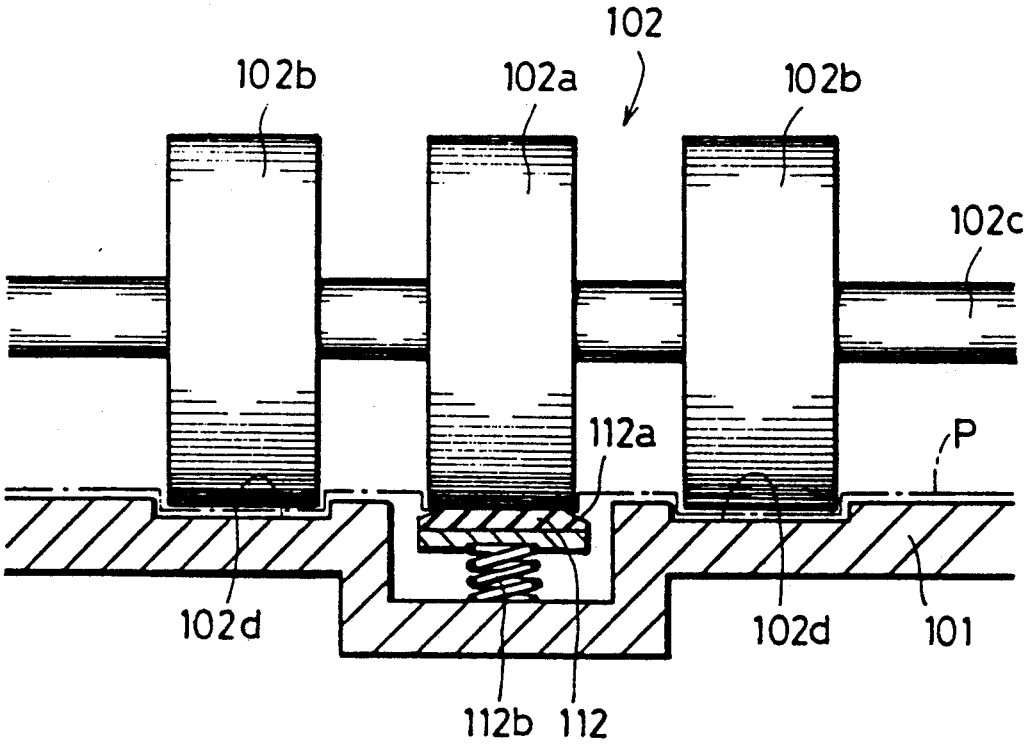
FIG. 17 is an enlarged and schematic longitudinal section showing the document tray and feed roller.

According to a test by the inventors of the paper (P) was most smooth when the angle $\theta 1$ from the upstream side of paper feeding of the document tray (101) to point A1 almost directly beneath the preliminary feed roller (103) in FIG. 16 was set at about 10°, the angle $\theta 2$ from point A1 to point A2 of the first crest (124) at about 10°, the angle $\theta 3$ from point A2 to the lower-most end of the root (125) at about 7°, and the angle $\theta 4$ from the lower-most end of the root (125) to the upper-most end of the second crest (126) at 25°.

The second paper feeding device (10) operates as described below. First the side control plate (118) is slid along the notch (117) so that the cut mark (118*a*) fits the desired paper size indication marked on the document tray (101). Then paper of that size is set on the tray (101). To set paper of especially large size, the projection (101*a*) is opened by turning it around the shaft (122) to support the paper on the rear end. The paper touches the limit switch (100) before reaching the guide member (104), the main motor starts turning and the rotation is transmitted to the idler gear (115) and further to the driving gear (116) to turn the preliminary feed roller (103). Accordingly, the paper in contact with the preliminary feed roller (103) goes through the paper feed channel, formed between the paper guide (104*d*) of the guide member (104) and the document tray (101), and is carried smoothly to the specified position.

At this time, the driving gear (116) is rotated in the direction of arrow R2 by the rotary force transmitted to the driving gear (116), and lifting force is applied, by which the end at the driving side of the shaft (107) of the preliminary feed roller (103) is pushed upward. However, the upward motion is constrained to some extent by the pressure section (104*a*) of the guide member (104), while the guide member (104) is pivoted around its shaft (104*e*) by the force acting upon the pressing section (104*a*). Accordingly, the guide member receiving section (104*b*) at the other end of the shaft (104*e*) is also pivoted, and so the second end of rod 107 is lifted. Therefore, the preliminary feed roller (103) is moved upward approximately in a horizontal condition, and the paper (P) can be set at the specified position easily. When the number of sheets is small, the paper can be placed at a position easily carried by the feed roller (102) while being put in contact with the first and the second crests (124) (126) of the document tray (101). If the number of sheets of paper is larger, the lower sheets of the paper come in contact with the root (125) and are prevented from advancing further, and only the upper sheet of the paper is advanced. Toward the upper sheet, the paper is inclined and the main motor stops when the upper-most sheet is put in contact with the specified position for easy carrying by the feed roller (102). Accordingly, the preliminary feed roller (103) is also stopped.

When the copying start button (not illustrated) is then pushed, the main motor starts turning, the driving gear (114) of the feed roller (102) turns in the direction of arrow R3 following the main motor, and the clutch (113) is engaged.

Then the rotary force is transmitted to the center roller (102*a*) and the auxiliary roller (102*b*). Following the idle gear (115) turning in the direction of arrow R1, the driving gear (116) of the preliminary feed roller (103) turns in the direction of arrow R2 to assist paper feeding from the document tray (101) into the copying machine. At this time, the center roller (102*a*) is in contact with the friction pad (112) which is pressed from the bottom by a spring to prevent double paper feeding. For carrying papers of high friction coefficient, carrying is assisted by the auxiliary rollers (102*b*).

When the paper (P) is fed further through the paper feed channel (45) composed of the upper and lower guide plates, and at a specified time after the front end of the paper touches the limit switch (60), the clutch (113) is disengaged to cut off transmission of the rotary force of the driving gear (114) to the feed roller (102), and the feed roller (102) comes to a stop. During the operation, the front end of the paper (P) meets the resistance of the resist roller (41), by which diagonal paper feeding is prevented and the timing with exposure is controlled. As soon as the feed roller (102) comes to a stop, the resist roller (41) starts turning to carry the paper (P) toward the transfer section T of the photoreceptor drum (31). Although the guide member (104) is composed of the pressing section (104*a*) at one end of the shaft (104*e*) and of the receiving section (104*b*) at the other end, it is also possible to compose the guide member (104) with a pressing section and a receiving section provided respectively at both ends of the shaft (104*e*).

The upper-stream side of the first crest (124) can be of any shape provided that the top end of the document tray (101) is formed as described above, i.e. the shape with the first and second crests (124) (126), and a root (125) in-between. A sharp slope from the top of the first crest (124) to the root (125) is also acceptable.

In the above embodiment, the auxiliary roller (102*b*) to assist paper feeding is provided at both sides of the center roller (102*a*) which is in contact with the friction pad (112). The invention, however, is not limit thereto, and the rollers to assist paper feeding may be located at any position so long as they are on the center roller (102*a*).

It may also possible to provide a pair of side control plates (118) so as to be interlocked in reverse directions with respect to each other and so that papers of different sizes are set approximately along the center line of the document tray (101) and to provide the center roller (102*a*) and the friction pad (112) corresponding to the center line. In this case, the guide member (104) can be of the composition having a plurality of receiving sections (104*b*) and no pressing section (104*a*).

Figure 18:
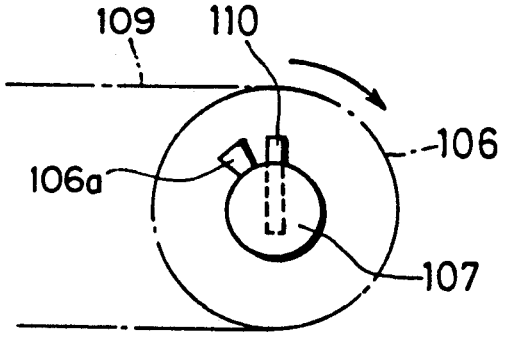
FIG. 18 is a schematic view showing another embodiment of the mechanism to transmit revolution to the preliminary feed roller.

FIG. 18 shows an embodiment to transmit rotary force to the shaft (107) of the preliminary feed roller (103) through a chain (109) and a sprocket (106). The sprocket (106) is provided with an interlocking projection (106*a*) and the shaft (107) is provided with a pin (110) which can be interlocked with the interlocking projection (106*a*). Accordingly, the shaft (107) can be rotated only when the sprocket (106) rotates and the pin (110) is interlocked with the interlocking projection (106*a*). When the sprocket (106) is stopped, the preliminary feed roller (103) can be turned freely by almost 360° in the same direction as the turning direction of the sprocket (106). In other words, the paper (P) can be set smoothly onto the document tray (101) because the preliminary feed roller (103) turns following insertion of the paper (P) even when the roller is not driven.

Accordingly, the limit switch (100) for detecting the paper (P) can be positioned between the preliminary feed roller (103) and the feed roller (102), and then the paper (P) can be advanced toward the resist roller (41) by rotating the feed roller (102) after detecting of the paper (P) by the limit switch (100). It is also possible to insert a one-way bearing instead of the interlocking projection (106*a*) and the pin (110).

In the above embodiment, the second paper feeding device (10) is applied to the stack by-pass mechanism. Even by applying the second paper feeding device (10) to the automatic document feeder, smooth setting and exact feeding of documents can be practiced in the same manner as in the above embodiment.

Figure 19:
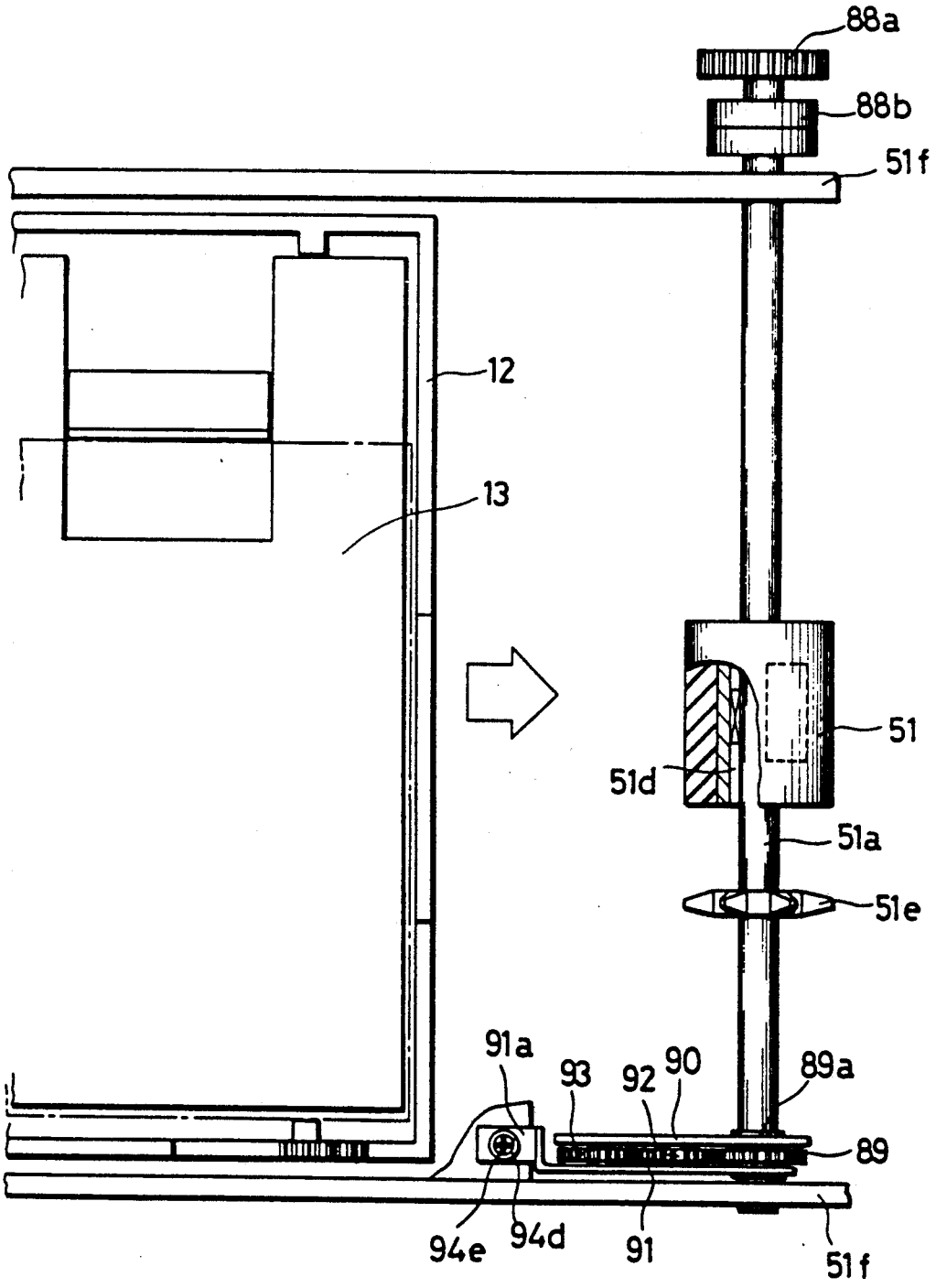
FIG. 19 is a plan view to show another embodiment of the paper feeding device of FIG. 1.
Figure 20:
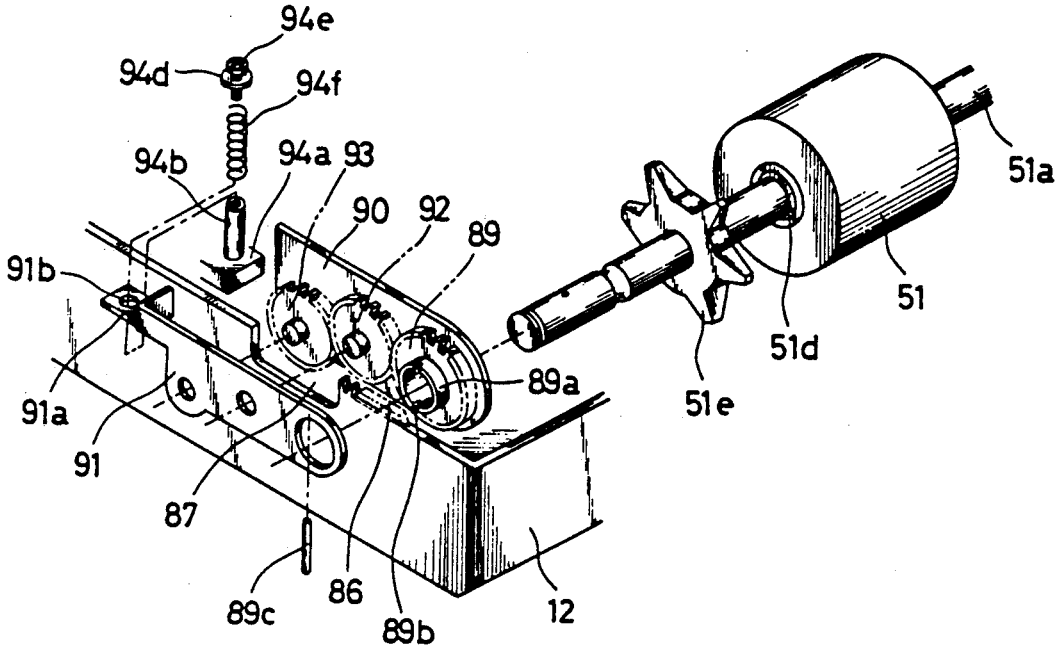
FIG. 20 is an exploded perspective view showing the principal part.

FIG. 19 to FIG. 23 are to show another embodiment of the 1st paper feeding device (5). Major differences from the above embodiment are that the feed roller (51) is attached to the shaft (51*a*) with a one-way bearing (51*d*) in-between, that a star wheel (51*e*) is attached to the shaft (51*a*) at a position far off the feed roller (51), and that a friction pad driving unit (58*a*) is attached for putting in contact or separating the friction pad (58) with the feed roller (51) to follow the mounting and dismounting operation of the paper feed cassette (12). All the rest of the device is implemented in the same manner as for the above embodiment. Accordingly, the same reference numbers are directed to the same components as in the above embodiment. The details are as described below. As shown in FIG. 19 and FIG. 20, the shaft (51*a*) is held so as to rotate freely through a pair of frames (51*f*), and a clutch (88*b*) is attached to the projected end of the shaft (51*a*). To the clutch (88*b*), a gear (88*a*) is attached to transmit rotary force from the driving power source, not illustrated The shaft (51*a*) and a gear (89) are interlocked so as to rotate together by means of the other projected end of the shaft (51*a*) and a cylindrical shaft (89*a*) of the gear (89), held together by an interlocking pin (89*c*) fixed and passed through the shaft (51*a*) with a pair of recesses (89*b*) on the end of the cylindrical shaft (89*a*).

The lever (91) and a gear attaching plate (90) support the shafts of gears (89) (92) and (93) so as to turn freely. The top end of the lever (91) is bent toward the gear attaching plate (90), and the lower part of the bent end is bent further to the top side to form an interlocking plate (91*a*) through which a hole (91*b*) is provided. A shaft (94*b*) extending up from the upper surface plate (94*a*) at the upper part of the mounted paper feed cassette (12) is loosely inserted into the hole (91*b*). A washer (94*d*) is fixed to the top end of the shaft (94*b*) with a screw (94*e*), and the shaft (94*b*)is inserted loosely into a push spring (94*f*) which is restrained at both ends by the washer (94*d*) and the interlocking plate (91*a*). Accordingly, the rack (86) and the gear (93) can be interlocked without any shock when the lever (91) and the gear attaching plate (90) are turned downward around the shaft (51*a*) by the push spring (94*f*) to mount and dismount the paper feed cassette (12).

The feed roller (51) is attached to approximately the middle of the shaft (51*a*) through a one-way bearing (51*d*), and rotary force is transmitted to the feed roller (51) only when the shaft (51*a*) is rotated in paper feeding direction from the paper feed cassette (12). The feed roller (51) turns freely relative to the shaft (51*a*) when the shaft (51*a*) is rotated in reverse direction on pulling out of the paper feed cassette (12) as the gear (93) interlocks with the rack (86) and when rotation of the shaft (51*a*) is stopped by the clutch (88*b*).

The star wheel (51*e*) is rotated together with the shaft (51*a*) and is attached to the shaft (51*a*) at a position not far off the feed roller (51) so as to be put in contact with the paper (P) accurately when the size of the paper (P) stored in the paper feed cassette (12) is changed. The star wheel (51*e*) is made of rubber, at least the edge of the peripery, to reduce the area in contact with the paper (P) and to ensure transmission of sufficient friction force. The friction pad driving unit (58*a*) is composed as described below.

Figure 21:
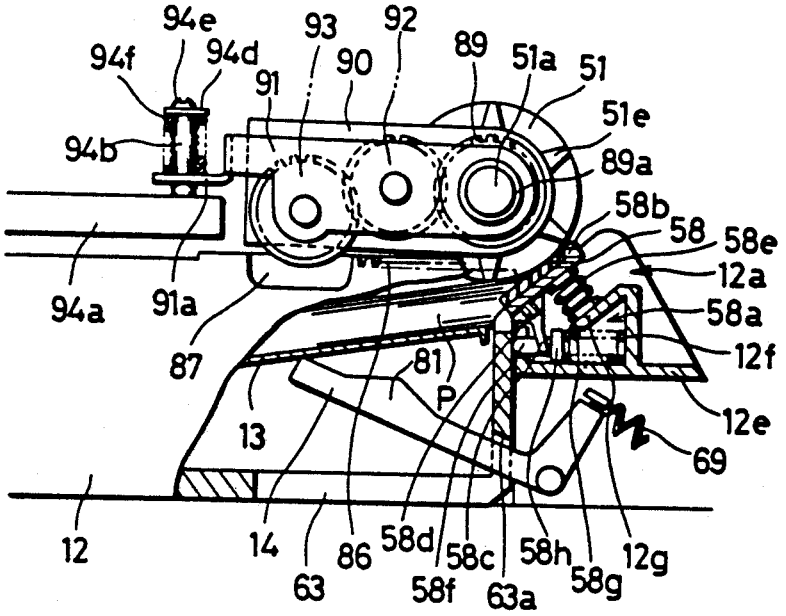
FIG. 21 is a side view showing the principal part.

As shown in FIG. 21, the upper end side of the lever (58*c*) connected to a friction pad support (58*b*) is supported by a shaft (58*d*) so as to rotate freely. The horizontal plate (12*e*) at the center of a contact member (12*a*) has the first receiver (12*f*) extending practically upright and also the second receiver (12*g*) extending downward diagonally from the top end of the first receiver (12*f*) to the paper feed cassette (12). In addition, a push spring (58*e*) is attached between the second receiver (12*g*) and the friction pad support (58*b*), and another push spring (58*g*), of higher strength than the push spring (58*e*), is attached between the first receiver (12*f*) and an interlocking member (58*f*) held on the horizontal plate (12*e*) so as to interlock the collar (58*h*) made at the base side of the interlocking member (58*f*) with the lower end of the lever (58*c*) at all times.

When the paper cassette (12) is not mounted, the interlocking member (58*f*) is projected from the contact part (12*b*) to the paper feed cassette setting side by the urging of the push spring (58*g*), and the lever (58*c*) is turned forcefully clockwise around the shaft (58*d*) by the collar (58*h*) of the interlocking member (58*f*). Accordingly, the friction pad (58) is separated from the feed roller (51).

When the paper cassette (12) is mounted, on the other hand, the interlocking member (58*f*)is pushed in by the front plate of the paper cassette (12) against the urging of the push spring (58*g*), and the friction pad support (58*b*) and also the lever (58*c*) are turned counter-clockwise around the shaft (58*d*) by the urging of the push spring (58*e*). Accordingly, the friction pad support (58) is pressed against the feed roller (51), and the feed roller (51) rotates to feed out the paper (P) sheet by sheet.

The lift-up lever (14) has a contacted part (81) composed of a projection of isosceles triangular shape, and the upper edge of the opening (63) in the paper cassette (12) has an inclined face (63*a*) which is forwardly slanted down.

In this embodiment, the paper feeding operation proceeds in the following manner.

When the paper cassette (12) is set in the copying machine housing (1), the inclined face (63*a*) goes over the contacted part (81) of isosceles triangular shape of the lift-up lever (14), and the release lever (75) is turned to unlock the lift-up lever (14), as in the case of the above embodiment. Then the lift-up lever (14) is turned upward by the coil spring (69). Accordingly, the document setting board (13) is turned upward to press the upper-most paper (P) against the feed roller (51). By insertion the paper cassette (12), the interlocking member (58*f*) is pushed inwardly against the push spring (58*g*). By urging of the push spring (58*e*), therefore, the friction pad support (58*b*) is turned counter-clockwise around the shaft (58*d*), and the friction pad (58) is pressed against the surface of the feed roller (51).

When the shaft (51*a*) is then rotated through the gear (88*a*) and the clutch (88*b*) for paper feeding, the rotary force is transmitted to the feed roller (51) through the one-way bearing (51*d*) making it possible to feed the paper (P) from the paper cassette (12). In the initial stage of paper feeding from the paper cassette (12), the front end of the paper (P) is led between the feed roller (51) and the friction pad (58). Even when two or more sheets of paper (P) are sent out, the paper is sent out sheet by sheet exactly to the down-stream side of the feed roller (51) and the friction pad (58).

Figure 22:
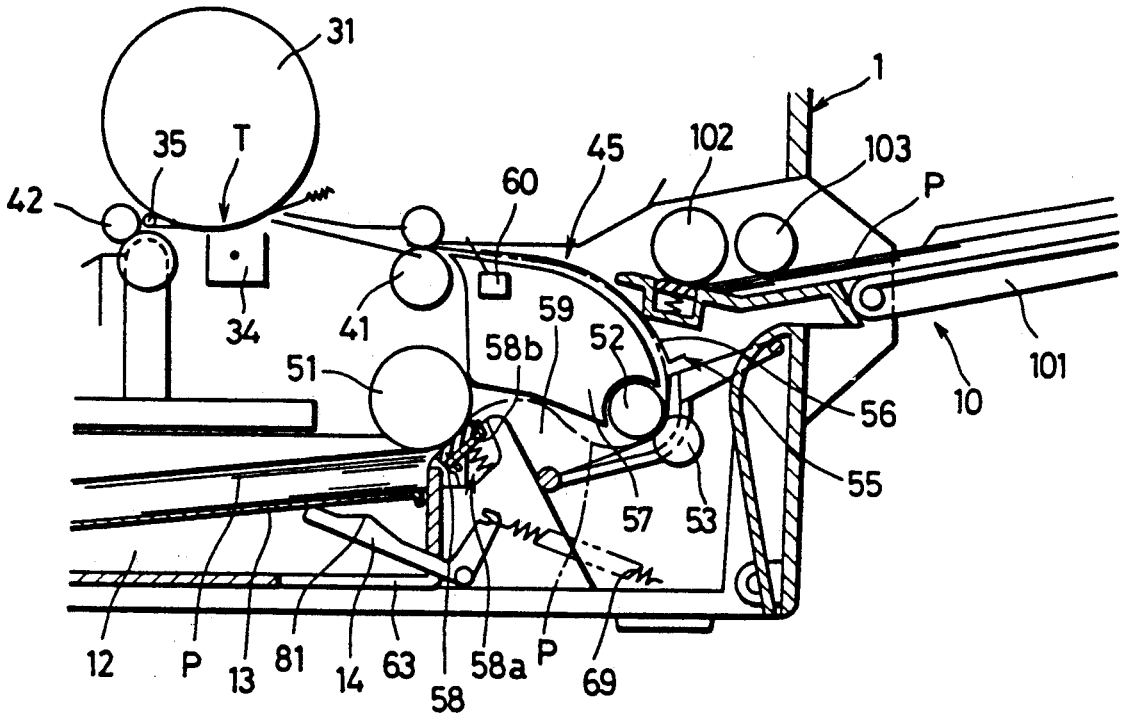
FIG. 22 is a schematic longitudinal section to show the condition of paper feeding from the paper cassette.
Figure 23:
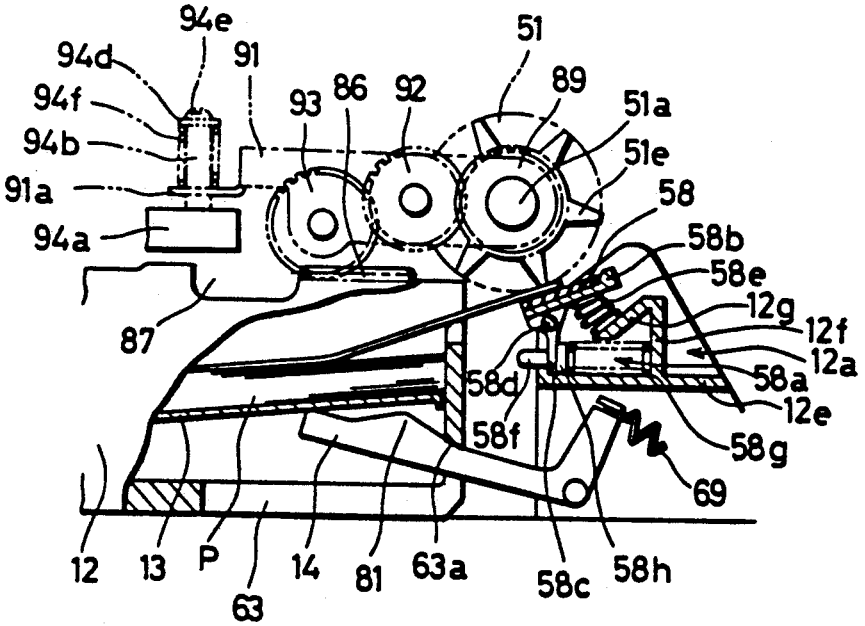
FIG. 23 is a side view showing the condition of pulling out paper feed cassette.

The paper (P) sent out sheet by sheet, as shown in FIG. 22, is led through the space (59) to the position between the delivery roller (52) and the driven roller (53), then is lead further to the guide (55) while the carrying force is transmitted by the delivery roller (52). Finally, the front end of the paper (P) comes in contact with the resist roller (41). Then the preliminary paper feeding completes as the carrying force is kept transmitted for a little while thereafter. As the clutch (88*b*) is so controlled to shut transmission of the rotary force when the preliminary paper feeding completes, the shaft (51*a*), the star wheel (51*e*) and the feed roller (51) stop rotating.

After completion of the preliminary paper feeding in this manner, the resist roller (41) is turned in timing with document exposure operation, i.e. the transfer timing of the lamp (21) and the reflecting mirrors (22) (23) (24) to start the main paper feeding. Since the main paper feeding is made by rotating the resist roller (41) while transmission of the rotary force to the feed roller (51) and the star wheel (51*e*) is being shut off, slackening of the paper (P) at the guide (55) is removed in the initial stage of the main paper feeding. When slackening is removed almost completely, carrying force is transmitted to the paper (P) by the delivery roller (52). It is possible, therefore, to feed the paper (P) exactly at the same speed as the speed of revolution of the photoreceptor drum (31) against the friction resistance caused by contact of the paper (P) with each part.

The length of the paper (P), however, is not necessarily constant. Some paper (P) is short to the extent that the rear end is separated from the feed roller (51) when the preliminary paper feeding completes, but other paper (P) may be longer, to the extent that the rear end is caught between the feed roller (51) and the friction pad (58) when the preliminary paper feeding completes.

If the paper (P) is short, and the resist roller (41) is turned, the feed roller (51) does not resist paper feed at all. Throughout the whole period of paper feeding by the resist roller (41), friction resistance is subjected to almost no change and paper feeding is carried out under even transfer of condition, which enables to transfer the toner image formed on the surface of the photoreceptor drum (31) onto the paper surface by the transferring corona discharger (34) without any positional deviation. If the paper (P) is long, the rear end of the paper (P) is caught between the feed roller (51) and the friction pad (58) in the initial stage of rotation of the resist roller (41), and outer end of the star wheel (51*e*) is kept in contact with the surface of the paper (P). As the resist roller (41) rotates, therefore, slackening of the paper (P) is removed, and then the feed roller (51) and the friction pad (58) function to resist the paper feeding. Being attached to the shaft (51*a*) through the one-way bearing (51*d*), the feed roller (51) rotates freely as the paper (P) is transfered and the resistance is smaller than that of the condition where the feed roller (51) is suspended. Accordingly, the resistance hardly changes even when the rear end of the paper (P) goes through the feed roller (51) and the friction pad (58) and transfer deviation of toner image due to changes in the resistance can be avoided almost completely.

The shaft (51*a*) and the feed roller (51) are attached with the one-way bearing (51*d*) in-between as shown in FIGS. 19 and 20. When the paper feed cassette (12) is pulled out and the shaft (51*a*) is rotated in the reverse direction, therefore, the rotary force in the reverse direction is not transmitted to the feed roller (51). Consequently, the sheet of paper (P) of which the front end is between the feed roller (51) and the friction pad (58) cannot be transferred to the paper feed cassette (12) by the feed roller (51). When the paper feed cassette (12) is pulled out, however, the interlocking member (58*f*) is moved by the push spring (58*g*), the collar (58*h*) is interlocked with the lever (58*c*) to turn the friction pad support (58*b*) in clockwise direction against the push spring (58*e*), and the friction pad (58) is separated from the feed roller (51). Thus, the front end of the paper is released. The rack (86) and the gear (93) are interlocked with each other in the middle of the pull-out motion of the paper feed cassette (12), and so turning force in reverse direction is transmitted to the shaft (51*a*) through the gear (92) (89), and the one-way bearing (51*d*) prevents the feed roller (51) from turning, but the star wheel (51*e*) is turned in the reverse direction of paper feeding. Because feed roller (51) and star wheel (51*e*) have a larger diameter than does gear (89), the paper is moved a greater distance than the distance which paper feed cassette (12) moves. The star wheel (51*e*) is made of rubber, at least on the edge of the periphery, and keeps a certain extent of friction resistance on the paper (P), which makes it possible to feed the paper (P) released as described above to the side of the paper feed cassette (12) and to keep the friction resistance between the friction pad (58) and the paper (P) at a very low level. This serves to prevent exactly the paper (P) from remaining in the copying machine housing (1) when the paper feed cassette (12) is pulled out. If the paper (P) remains in the copying machine housing (1) when the paper cassette (12) is pulled out with the front end being caught between the feed roller (51) and the friction pad (58), the remaining paper (P) is crumpled when the paper feed cassette (12) is mounted next time, and jamming is very probable. By the above embodiment, however, jamming can be prevented as the paper (P) is not left in the housing (1).

For the type of copying machines where a larger portion of the paper feed cassette (12) is inserted into the housing (1) of the copying machine, the embodiment to prevent residual paper (P) completely is practically very effective, as it is not easy to check for any remaining paper (P) from the outside.

What we claim is:

1. A document feeding device for an image-forming machine, to feed a document in a document-feeding direction into the image-forming machine from a document tray mounted on the image-forming machine, said document feeding device comprising:

a preliminary feed roller unit;

first mounting means rotatably mounting said preliminary feed roller unit on the image-forming machine adjacent the downstream end of the document tray, with respect to the document-feeding direction, when the document tray is mounted on the image-forming machine, while permitting said preliminary feed roller unit to freely move up and down with respect to the document tray;

a second feed roller unit;

second mounting means rotatably mounting said second feed roller unit on the image-forming machine downstream of said preliminary feed roller unit, with respect to the document feeding direction;

drive means responsive to presence of a stack of one or more documents on the document tray for rotating said preliminary feed roller unit to feed the top document of the stack in the document-feeding direction from the document tray toward said second feed roller unit; and a guide member mounted on the image-forming machine and including means responsive to rotation of said preliminary feed roller unit during feeding of documents from the stack for moving said preliminary feed roller unit up with respect to the document tray, against the downward force of gravity, whereby upon placement of a stack of one or more documents on the document tray, said preliminary feed roller unit is moved up in a substantially horizontal position and rotated to feed the top document of the stack toward the image-forming machine and into contact with the second feed roller regardless of the height of the stack of documents.

2. A paper feeding device according to claim 1, wherein said guide member comprises a pushing section extending over a first end-portion of the preliminary feed roller unit and a receiving section extending beneath a second end-portion of the preliminary feed roller unit.

* * * * *